US007048471B2

(12) United States Patent
Kadiu

(10) Patent No.: US 7,048,471 B2
(45) Date of Patent: May 23, 2006

(54) SHORING DEVICE

(76) Inventor: Maksim Kadiu, 19694 Aburn Dr., Cupertino, CA (US) 95014

( * ) Notice: Subject to any disclaimer, the term of this patent is extended or adjusted under 35 U.S.C. 154(b) by 0 days.

(21) Appl. No.: 10/414,710

(22) Filed: Apr. 15, 2003

(65) Prior Publication Data

US 2004/0005197 A1 Jan. 8, 2004

Related U.S. Application Data

(63) Continuation-in-part of application No. 09/543,442, filed on Apr. 5, 2000, now Pat. No. 6,821,057.

(51) Int. Cl.
*E02D 5/00* (2006.01)

(52) U.S. Cl. ..... 405/282

(58) Field of Classification Search ..... 405/272, 405/282, 284

See application file for complete search history.

(56) References Cited

U.S. PATENT DOCUMENTS

| | | | |
|---|---|---|---|
| 1,794,704 | A | 3/1931 | Miller |
| 1,847,842 | A | 3/1932 | Cauley, Jr. et al. |
| 1,877,351 | A | 9/1932 | Meem |
| 1,895,985 | A | 1/1933 | Goldsborough |
| 1,909,980 | A | 5/1933 | Newman |
| 2,188,077 | A | 1/1940 | Dowd |
| 2,350,113 | A | 5/1944 | Hurley |
| 2,482,367 | A | 9/1949 | Ravers, Jr. |
| 2,584,015 | A | 1/1952 | Hawes |
| 2,659,210 | A | 11/1953 | Stengel et al. |
| 2,796,738 | A | 6/1957 | Moore |
| 2,908,140 | A | 10/1959 | Everson, Jr. |
| 2,956,409 | A | 10/1960 | Wicke |
| 2,994,974 | A | 8/1961 | Domenighetti |
| 3,047,931 | A | 8/1962 | Boettner |
| 3,159,977 | A | 12/1964 | De Lillo |
| 3,159,978 | A | 12/1964 | De Lillo |
| 3,186,177 | A | 6/1965 | Kannenberg |
| 3,212,270 | A | 10/1965 | Benintend |
| 3,224,201 | A | 12/1965 | Brunton |

(Continued)

*Primary Examiner*—Gary S. Hartmann
(74) *Attorney, Agent, or Firm*—Morrison & Foerster LLP

(57) ABSTRACT

This apparatus relates to shoring of deep excavations such as pits or trenches. It includes vertical rail posts arranged symmetrically in pairs that are spaced from each other along the excavation, articulated trusses and/or spreaders holding opposite rail posts against each other and large shoring panels sliding between adjacent rail posts on either side of the excavation. Each rail post has on either side one channel of a stepped or non-stepped cross section guiding vertically two or more shoring panels. In one variation, the inner and outer panel guides on one side of the vertical rail post reside in the same vertical plane. The connections between the rail post and the wall panels are partially or completely open. The open connections may be performed by magnetic forces arising from thin magnetic flat bars incorporated in the posts or the panels in the area of their contact. The articulated truss may be of a scissoring type and may be composed of triangular cells only and their members may have pinned connections. The cross members of the truss are pinned together in their mid-length enabling their relative rotation while their extremities are pinned into vertical members which have several rows of pinning holes in order to adjust the width of the trench without the need for additional spreaders. The vertical members of the truss slide formlockingly between a pair of opposite posts and could be adjusted at any level from the bottom of excavation. The truss may also include one or more rollers that facilitate its vertical mobility.

53 Claims, 31 Drawing Sheets

U.S. PATENT DOCUMENTS

| | | | |
|---|---|---|---|
| 3,230,720 | A | 1/1966 | Bennett |
| 3,263,430 | A | 8/1966 | Bryan |
| 3,295,330 | A | 1/1967 | Meshorer |
| 3,331,210 | A | 7/1967 | Wenninger |
| 3,335,573 | A | 8/1967 | Ward |
| 3,347,049 | A | 10/1967 | Faltersack et al. |
| 3,362,167 | A | 1/1968 | Ward |
| 3,379,018 | A | 4/1968 | Frentzel et al. |
| 3,393,521 | A | 7/1968 | Cammisa |
| 3,404,533 | A | 10/1968 | Brunton |
| 3,470,699 | A | 10/1969 | Cox |
| 3,530,679 | A | 9/1970 | Krings |
| 3,584,465 | A | 6/1971 | Holl |
| 3,593,528 | A | 7/1971 | Pavese |
| 3,621,660 | A | 11/1971 | Krings |
| 3,668,874 | A | 6/1972 | Krings |
| 3,710,578 | A | 1/1973 | Inoue |
| 3,727,413 | A | 4/1973 | Christen |
| 3,729,938 | A | 5/1973 | Morrice |
| 3,766,740 | A | 10/1973 | Teegen |
| 3,782,125 | A | 1/1974 | Holl |
| 3,782,126 | A | 1/1974 | Pavese |
| 3,788,086 | A | 1/1974 | West, Jr. |
| 3,791,151 | A | 2/1974 | Plank |
| 3,831,384 | A | 8/1974 | Kempster |
| 3,851,856 | A | 12/1974 | Berg |
| 3,858,399 | A | 1/1975 | Krings |
| 3,864,921 | A | 2/1975 | Marx et al. |
| 3,869,867 | A | 3/1975 | Krings |
| 3,881,679 | A | 5/1975 | Krings |
| 3,910,053 | A | 10/1975 | Krings |
| 3,910,054 | A | 10/1975 | Krings |
| 3,937,026 | A | 2/1976 | Krings |
| 3,950,952 | A | 4/1976 | Krings |
| 3,967,454 | A | 7/1976 | Barnes |
| 3,969,852 | A | 7/1976 | Krings |
| 3,995,565 | A | 12/1976 | Kersey |
| 3,999,393 | A | 12/1976 | Krings |
| 4,019,328 | A | 4/1977 | Koehl |
| 4,048,778 | A | 9/1977 | Krings |
| 4,054,033 | A | 10/1977 | Pillosio |
| 4,056,940 | A | 11/1977 | Fisher |
| 4,059,964 | A | 11/1977 | Pavese |
| 4,090,365 | A | 5/1978 | Nieber |
| 4,099,386 | A | 7/1978 | Sagasta |
| 4,114,383 | A | 9/1978 | Nieber |
| 4,139,324 | A | 2/1979 | Krings |
| 4,145,891 | A | 3/1979 | Krings |
| 4,154,062 | A | 5/1979 | Koehl |
| 4,159,585 | A | 7/1979 | Brown |
| 4,168,053 | A | 9/1979 | Boenninghaus |
| 4,188,159 | A | 2/1980 | Clarke et al. |
| 4,199,278 | A | 4/1980 | Koehl |
| 4,202,649 | A | 5/1980 | Cook et al. |
| 4,247,997 | A | 2/1981 | Paurat et al. |
| 4,259,028 | A | 3/1981 | Cook |
| 4,259,029 | A | 3/1981 | Koehl |
| 4,259,030 | A | 3/1981 | Montoya |
| 4,274,763 | A | 6/1981 | Krings |
| 4,279,548 | A | 7/1981 | Ramey |
| 4,310,267 | A | 1/1982 | Davis |
| 4,345,857 | A | 8/1982 | Krings |
| 4,370,079 | A | 1/1983 | Pizzirani |
| 4,372,709 | A | 2/1983 | Krings |
| 4,376,599 | A | 3/1983 | Krings |
| 4,421,440 | A | 12/1983 | Scheepers |
| 4,453,861 | A | 6/1984 | Bretz et al. |
| 4,453,863 | A | 6/1984 | Sutton et al. |
| 4,472,090 | A | 9/1984 | Krings |
| 4,484,842 | A | 11/1984 | Engelhaupt |
| 4,487,530 | A | 12/1984 | Morrice |
| 4,501,517 | A | 2/1985 | Seyle |
| 4,521,137 | A | 6/1985 | Brecht |
| 4,547,097 | A | 10/1985 | Bell |
| 4,548,528 | A | 10/1985 | Bell |
| 4,591,298 | A | 5/1986 | Fukumori et al. |
| 4,657,442 | A | 4/1987 | Krings |
| 4,659,261 | A | 4/1987 | Chiaves |
| 4,682,914 | A | 7/1987 | Aihara et al. |
| 4,685,837 | A | 8/1987 | Cicanese |
| 4,695,204 | A | 9/1987 | Bell |
| 4,696,607 | A | 9/1987 | Ressi di Cervia |
| 4,752,157 | A | 6/1988 | Ischebeck et al. |
| 4,787,781 | A | 11/1988 | Bradberry |
| 4,843,780 | A | 7/1989 | Krings |
| 4,874,271 | A | 10/1989 | Arnold |
| 4,886,399 | A | 12/1989 | Pidgeon |
| 4,900,197 | A | 2/1990 | Ward |
| 4,960,258 | A | 10/1990 | Stocker et al. |
| 4,993,877 | A | 2/1991 | Beamer |
| 4,993,878 | A | 2/1991 | Beamer |
| 4,993,880 | A | 2/1991 | Collins |
| 5,000,621 | A | 3/1991 | Beamer |
| 5,011,331 | A | 4/1991 | Clavarino |
| 5,044,831 | A | 9/1991 | Myles et al. |
| 5,052,862 | A | 10/1991 | Uffmann |
| 5,073,066 | A | 12/1991 | Richland |
| 5,080,533 | A | 1/1992 | Cooper |
| 5,096,334 | A | 3/1992 | Plank |
| 5,123,785 | A | 6/1992 | Orfei |
| 5,129,763 | A | 7/1992 | Deusenbery |
| 5,154,541 | A | 10/1992 | Boren et al. |
| 5,158,398 | A | 10/1992 | Pinho |
| 5,167,468 | A | 12/1992 | Crafton |
| 5,174,685 | A | 12/1992 | Buchanan |
| 5,180,256 | A | 1/1993 | Krings |
| 5,183,316 | A | 2/1993 | Ottestad |
| 5,188,332 | A | 2/1993 | Callas |
| 5,190,412 | A | 3/1993 | Salvatore |
| 5,195,849 | A | 3/1993 | Stapleton |
| 5,197,829 | A | 3/1993 | Krings |
| 5,199,824 | A | 4/1993 | Smith et al. |
| 5,209,606 | A | 5/1993 | Plank |
| 5,232,312 | A | 8/1993 | Jennings et al. |
| 5,232,313 | A | 8/1993 | Jennings et al. |
| 5,259,705 | A | 11/1993 | Breaux et al. |
| 5,277,522 | A | 1/1994 | Pertz |
| 5,281,051 | A | 1/1994 | Stegall |
| 5,290,129 | A | 3/1994 | Rody et al. |
| 5,302,054 | A | 4/1994 | Winkler et al. |
| 5,305,568 | A | 4/1994 | Beckerman |
| 5,306,103 | A | 4/1994 | Spencer |
| 5,310,289 | A | 5/1994 | Hess |
| 5,310,290 | A | 5/1994 | Spencer |
| 5,320,440 | A | 6/1994 | Papadopoulos |
| 5,336,023 | A | 8/1994 | Burdine |
| 5,344,258 | A | 9/1994 | Papadopoulos |
| 5,348,421 | A | 9/1994 | Stegall |
| 5,393,171 | A | 2/1995 | Stegall |
| 5,399,057 | A | 3/1995 | Cunic |
| 5,401,122 | A | 3/1995 | Pate, Jr. |
| 5,499,890 | A | 3/1996 | Kishi |
| 5,503,504 | A | 4/1996 | Hess et al. |
| 5,513,555 | A | 5/1996 | Plank et al. |
| 5,516,238 | A | 5/1996 | Beury |
| 5,522,678 | A | 6/1996 | Marshall et al. |
| 5,527,137 | A | 6/1996 | Spencer |
| 5,533,838 | A | 7/1996 | Kundel |
| 5,595,459 | A | 1/1997 | LoMonaco |
| 5,611,643 | A | 3/1997 | Tallard |
| 5,624,206 | A | 4/1997 | Cohen et al. |
| 5,669,738 | A | 9/1997 | Kundel |
| 5,720,580 | A | 2/1998 | Ryhsen |
| 5,725,330 | A | 3/1998 | Krings |

5,735,642 A 4/1998 Barringer
5,741,091 A 4/1998 St. George et al.
5,829,921 A 11/1998 Krings
5,839,707 A 11/1998 Barringer
5,865,567 A 2/1999 Wilkinson
5,868,060 A 2/1999 Plank et al.
5,868,526 A 2/1999 Caulder
5,876,153 A 3/1999 Krings
5,885,033 A 3/1999 Krings
5,902,075 A 5/1999 Krings
5,931,607 A 8/1999 Hess
5,931,608 A 8/1999 Wilkinson
6,017,170 A 1/2000 Michalo
6,039,522 A 3/2000 Cardona
6,155,750 A 12/2000 Wu et al.
6,164,874 A 12/2000 May
6,164,875 A 12/2000 Wu et al.
6,224,296 B1 5/2001 Fukumori
6,267,538 B1 7/2001 Caldwell
6,416,259 B1 7/2002 Meyer
6,443,665 B1 9/2002 Kundel, Sr.
6,474,911 B1 11/2002 Krings

VIEW I-I

VIEW I-I

VIEW 2-2

SHORING DEVICE

CROSS-REFERENCE TO RELATED APPLICATIONS

This is a continuation in part application of U.S. patent application Ser. No. 09/543,442, filed Apr. 5, 2000, now U.S. Pat. No. 6,821,057, which is incorporated in its entirety by reference.

TECHNICAL FIELD

This invention relates to shoring apparatuses or devices for trenches, pits or other types of open excavations employed in the construction industry.

BACKGROUND OF THE INVENTION

In the construction industry trenches, pits and other types of open excavations require the use shoring devices. Various known shoring devices include vertical rail posts, shoring panels and horizontal spreaders pressing the shoring walls against the side wall of the trench. Such shoring devices are called 'Slide Rail Shoring Systems'.

Previous slide rail shoring systems as disclosed in U.S. Pat. Nos. 3,910,053 and 4,657,442 (Krings) use a rail post having individual formlocking channel connections of 'C' type for sliding the panels. The load developed by the active pressure of the excavation walls is spread on very limited areas of contact between the post and panel. The stresses are highly concentrated at these areas becoming sources of high friction and temperature during the installation and removal of the system. Thus, damage is caused to both rail post and the panel, which strongly limits the application of such a system in pipeline productions, where the installation and removal of the system are effectuated continuously.

U.S. Pat. Nos. 5,310,289 and 5,503,504 (Hess et al.), disclose a rail post having a unique channel for a maximum of two shoring walls, created by an outer panel and an inner panel. Only the outer panel slides formlockingly within the post; the inner panel is completely free and slides inside the outer panel and the rail posts. The design of the inner panel presents a risk of kicking in the trench when adjacent rail posts are not plumb. This is an important safety concern for the worker inside the trench. This phenomenon becomes prominent when the depth of excavation is over 20' deep. On the other hand, shoring of excavations over 16' deep requires the stacking and connection of two or more panels, which later must be removed at once. Removing two or more panels at once is a very difficult task and sometimes even impossible to accomplish even when heavy duty equipment is used. Yet another concern faced by this design is the difficulty of removing the inner panel when the deflection of the upper panel has begun. Also, it should be noted that a slide rail shoring system using differing types of panels requires a much bigger inventory of panels than a system that uses interchangeable panels.

U.S. Pat. No. 3,950,952 (Krings), U.S. Pat. Nos. 5,310,289 and 5,503,504 (Hess et al) disclose very similar strut frames having a rectangular structure where the vertical members are equipped with rollers. These frames are designed to slide vertically between opposite rail posts in order to support the load coming from either side of the shoring walls. From an engineering standpoint, a frame having a rectangular cell is not a stable structure because it allows deformations without affecting the length of its members. For example, a rectangular cell may twist into a parallelogram. Additionally, the lower horizontal strut of the frame diminishes the pipe culvert thereby requiring special solutions for the installation of pipes having big diameters or of big box culverts.

BRIEF SUMMARY OF THE INVENTION

This invention relates to shoring devices for open excavations such as trenches and pits. The device includes vertical rail posts spaced apart from each other along the trench and arranged symmetrically on both sides of the trench. Opposite rail posts are kept vertically equidistant on either side of the trench by an articulated truss able to adjust the trench width. In one variation, the rail post has on both sides a channel of stepped cross section. Each step constitutes a vertical guide to slide at least one shoring panel. The shoring panels slide between each corresponding guide of adjacent rail posts and, according to the number of the guides, form two or more shoring walls. Thus, the panels slide past each other creating a stepped shoring wall from the top to the bottom of the excavation. The outermost and innermost steps of the shoring wall are called respectively "outer" and "inner walls" and so the panels. All other panels in between are called "intermediate".

In one shoring device, the connections between rail posts and shoring panels are maintained by magnetic forces arising from one or more magnetic flat bars incorporated in the lateral ends of the panels. For safety purposes partial locking may be used for the outer and inner panels. The intermediate panels slide completely free relative to the rail post.

My articulated truss is of a scissoring type and may be composed of triangular cells. The cross members of the truss may be pinned at their midlength allowing rotation relative to each other. Such rotation allows adjustment of the truss width to several trench widths. The extremities of the cross members are pinned into vertical members of the truss which slide "formlockingly" along the rail post. For very deep applications, the vertical members of the truss generally have lateral guides for sliding additional panels at the bottom of the excavation.

A shoring device of the type described above reduces the friction and the stresses in the contacts between components, while increasing the safety and ease of use in great depths. A rail post having channels of stepped cross section permits more than two shoring walls in that single channel structure without increasing the material expenditure. Interference between panels is also reduced. When the vertical guide of the rail post has a of stepped cross section, it eliminates the contact between rail post and back panel, while the contact area in the front panel is increased. Also, magnetic flat bars may be incorporated in the lateral ends of the panels thereby simplifying the connections between the rail post and panels, reducing the risk of damage.

A slide rail system includes partially or completely open sliding connections for the panels along the rail post. Also, a rail post is described in which two or more panels may slide past each other, without need for stacking those panels. This tremendously extends the shoring depth for a slide rail shoring system.

Another aspect of this invention is an articulated truss able to adjust to several trench widths, while providing for a big pipe culvert. The truss is thus able to perform a role in addition to supporting opposing rail posts. Also, accessory devices may be used in conjunction with the slide rail shoring system to increase safety and to facilitate its installation and removal.

Another device for shoring a trench is a vertical rail that comprises opposing sides, each opposing side having an inner and outer wall panel guide. Each of the inner wall panel guides is adapted to slidably interlock with an inner wall panel and each of the outer wall panel guides is adapted to slidably interlock with an outer wall panel such that the inner and outer wall panels may be moved vertically.

The vertical rail further comprises a vertically disposed truss guide that can cooperatively engage the movable truss. The truss guide may vary widely in form. In one variation, the truss guide is a tube having a round cross section. It may be mounted on the exterior or interior of the vertical rail. The truss guide may also be a vertical section of a tubular member having an arcuate cross section. The arcuate cross section may form an arc having an angle greater than 180 degrees.

An inner wall panel and an outer wall panel may be provided wherein the inner wall panel and outer wall panel are equal in length. Also, the inner wall panel guide and the outer wall panel guide on one side of the vertical rail may be situated in the same plane, as opposed to having a stepped or other type of structure.

The device may also include a mobile truss comprising a frame and end assemblies. Each end assembly is adapted to cooperatively engage the truss guide of the vertical rail when the vertical rails are positioned across from one another in the trench such that the truss may be vertically moved. The truss may include, in one variation, a round guide member that slidably accepts (or is accepted by) the truss guide of the vertical rail. Each end assembly of the truss may comprise at least one roller. Also, each end assembly of the truss may comprise an upper and lower assembly, each of which comprises at least one roller. The upper and lower assemblies may be connected to a horizontal strut via an upper beam and lower beam respectively.

The truss and/or vertical rail may include one or more apertures such that the truss may be locked in place with a pin or fastener.

A spreader for shoring applications comprises a frame and first and second end assemblies. Each end assembly comprises a vertical guide member having a circular cross section that is configured to slidably interlock with a vertical rail post such that the spreader may be moved vertically when the spreader is engaged with the vertical rail post.

The guide member may be a circular tube that is either exteriorly or interiorly mounted to a spreader end assembly. It may be hollow or solid. Also, the guide member may be a vertical section of a circular tube having an arcuate cross section.

Each spreader end assembly may include at least one roller. Also, each end assembly may comprise an upper roller assembly and a lower roller assembly. Each of the upper and lower roller assemblies may comprise at least one roller that contacts a surface of the vertical rail post when the spreader is slidably engaged with the vertical rail post. The guide member may extend vertically from the upper roller assembly to the lower roller assembly. Each end assembly may be configured to be pinnable to a vertical rail post.

The frame of the spreader, in one variation of the invention, comprises at least one strut. It may comprise more than one or only one horizontal strut. Also, the frame and spreader may be nonarticulating.

Another vertical rail for use in shoring trenches comprises opposing sides of stepped cross section. Each opposing side has an inner and outer wall panel guide. Each inner wall panel guide being adapted to slidably interlock with an inner wall panel and each outer wall panel guide being adapted to slidably interlock with an outer wall panel such that the inner and outer wall panels are substantially locked horizontally but may be moved vertically. The rail post further includes a truss guide being adapted to cooperatively engage an end assembly of a mobile truss such that the truss may be vertically moved.

The stepped channel structure may comprise a central tube and at least two ancillary tubes mounted to the central tube. The ancillary tubes may be mounted up-front or on the sides of the central tube. The tubes may be rectilinear.

Also, the stepped structure may be formed of a flange having at least two bends. One or more supporting plates may be mounted within the flange. One or more of the plates may be inclined. Instead of (or in addition to) the flange structure, the stepped channel structure may comprise a plurality of discrete straight plates, angular members, channel-shaped members, or a combination of one or more types of members. For example, the panel guides may be formed from a channel-shaped member having a U-shaped cross section.

The shape of my truss guide may also vary. It may have, for example, a channel-shape (e.g., U-shape), angular, or round in cross section. It may be mounted on the exterior or interior of the vertical rail. In one variation, the truss guide is a vertical section of an elongated circular tube having an arcuate cross section. The truss guide may also be formed of a plurality of straight plates. One or more of the pieces or plates may be inclined.

In another variation, the vertical rail post comprises at least one intermediate wall panel guide situated between the inner and outer wall panel guides. The intermediate guide is adapted to slidably engage an intermediate wall panel. This structure may comprise, for example, a flange having four bends, straight plates, angles, channel-shaped plates, or a combination of members.

At least one of the truss guide and vertical rail may be adapted to receive a pin or other type of fastener to lock a movable truss in place.

Other aspects and advantages of the invention will be appreciated upon review of the following description and drawings.

BRIEF DESCRIPTION OF THE SEVERAL VIEWS OF THE DRAWINGS

FIG. 1*a* is a sectional view of a trench showing two rail posts and an articulated truss in between.

FIGS. 3*b*' and 3*b*" are a front view and side view respectively of a vertical rail post.

DETAILED DESCRIPTION OF THE INVENTION

Figure 1A:
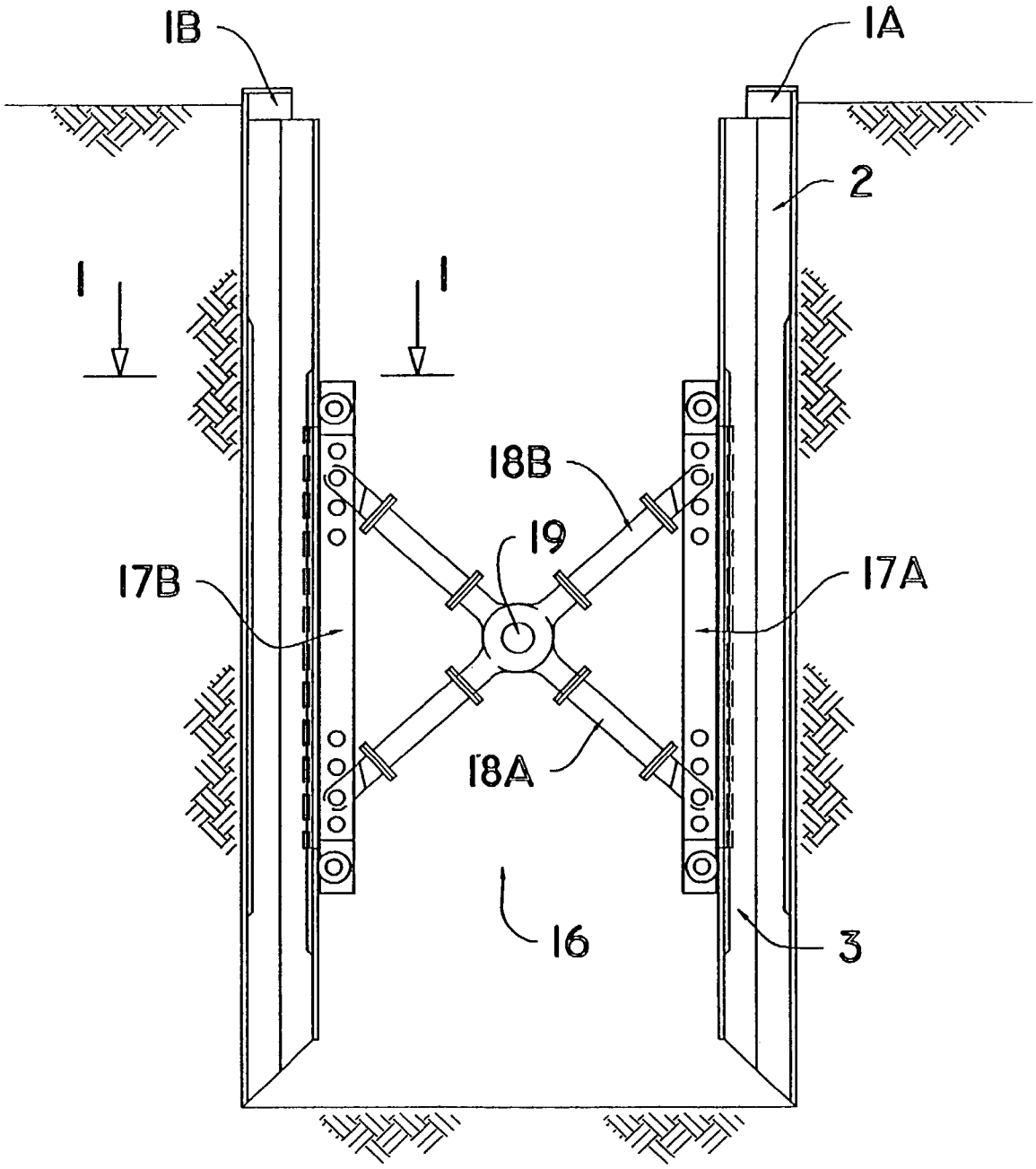

Referring to the drawings where like numerals indicate like elements, various embodiments of the present invention are illustrated.

A shoring device has two or more pairs of rail posts spaced apart from each other along the excavation. FIG. 1*a* illustrates a pair of linear rail posts 1A and 1B, located symmetrically on either side of the trench. Each rail post has laterally on either side at least two guides 2 and 3 for sliding large shoring panels between adjacent rail posts. The opposite rail posts 1A and 1B are kept vertically equidistant by an articulated truss 16, which is composed of cross members 18A and 18B, pinned together at their midlength with the axle pin 19, and by the vertical members 17A and 17B.

Figure 1B:
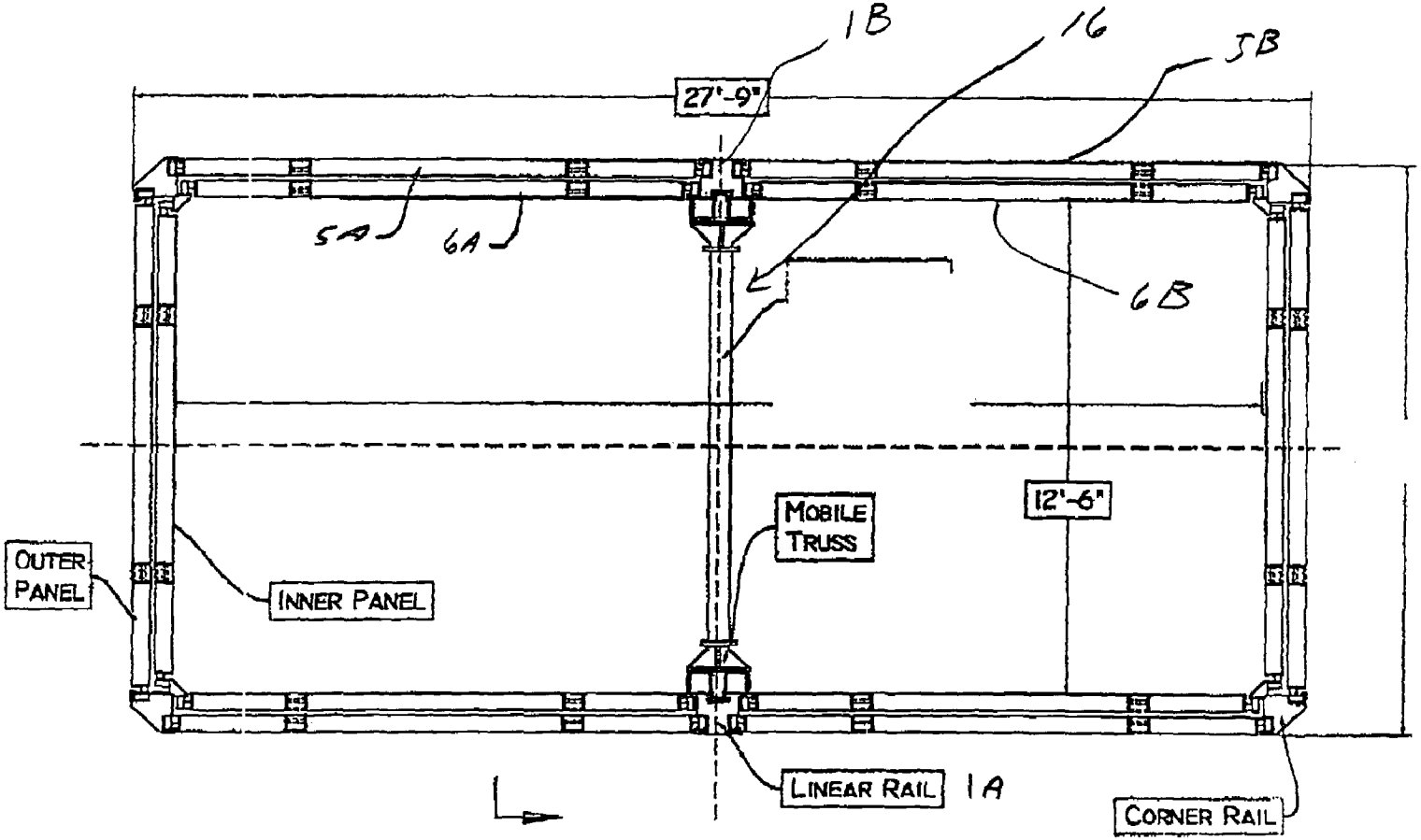
FIG. 1*b* is a top view of a shoring system including shoring wall panels, vertical rail posts, and a movable truss.
Figure 1C:
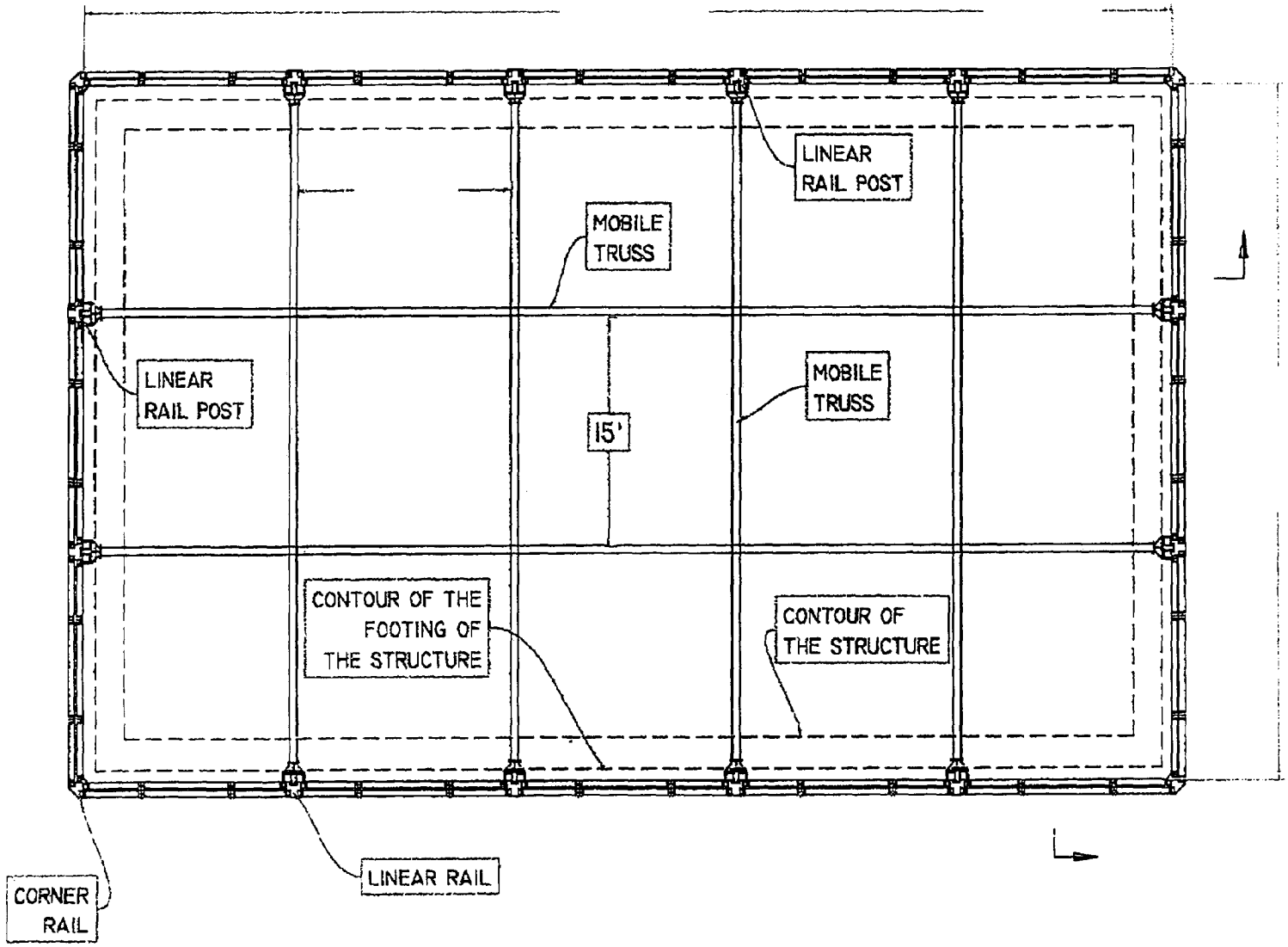
FIG. 1*c* is a top view of another shoring system including shoring wall panels, vertical rails, and mobile trusses.

A top view of an assembled shoring device is shown in FIGS. 1*b* and 1*c*. FIG. 1*b* is a top view of an assembled shoring device including vertical rail posts 1A, 1B, corner posts, inner wall panels 6A, 6B outer wall panels 5A, 5B and a movable truss 16. FIG. 1*c* is a top view of another shoring system including a plurality of vertical rails, wall panels, corner posts, and mobile trusses. The shoring system illustrated in FIG. 1*c* is preferred in large pit applications because it includes a plurality of adjacent vertical rails and mobile trusses.

Figure 2:
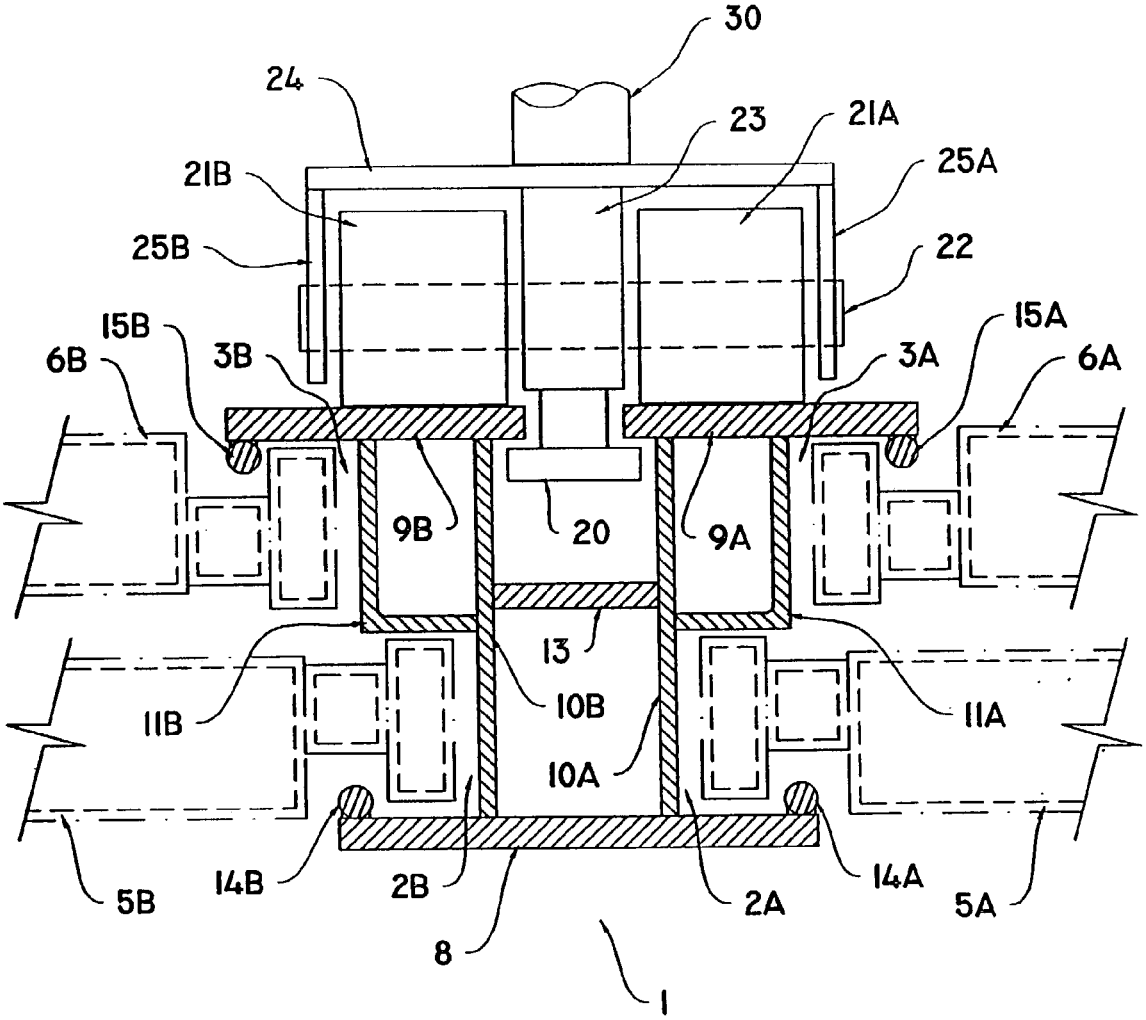
FIG. 2 is a sectional view taken along the line I—I of the FIG. 1A, showing a cross section of the rail post, shoring panels laterally on either side, and the top view of the vertical guide member of the articulated truss.

As shown in FIG. 2, the panel guides 2A and 3A are inside a unique channel of stepped cross section shaped by the pieces 8, 9A, 10A, and the angle 11A. The round bars 14A and 15A partially lock the shoring panels 5A and 6A, and round bars 14B and 15B partially lock shoring panels 5B and 6B, thereby shaping the outer and inner shoring walls.

The front side of the rail post 1, as viewed looking into the excavation, has a 'C' channel shaped by the pieces 9A, 9B, 10A, 10B and 13, wherein one vertical member of the articulated truss 16 slides and is horizontally locked by the T shaped piece 20. The load originating from the excavation wall is transmitted from the panels to the articulated truss through the rail post and the rollers 21A and 21B which are supported by the axles 22, axle holder 23, and located at the extremities of the vertical member 17 of the truss.

Figure 3A:
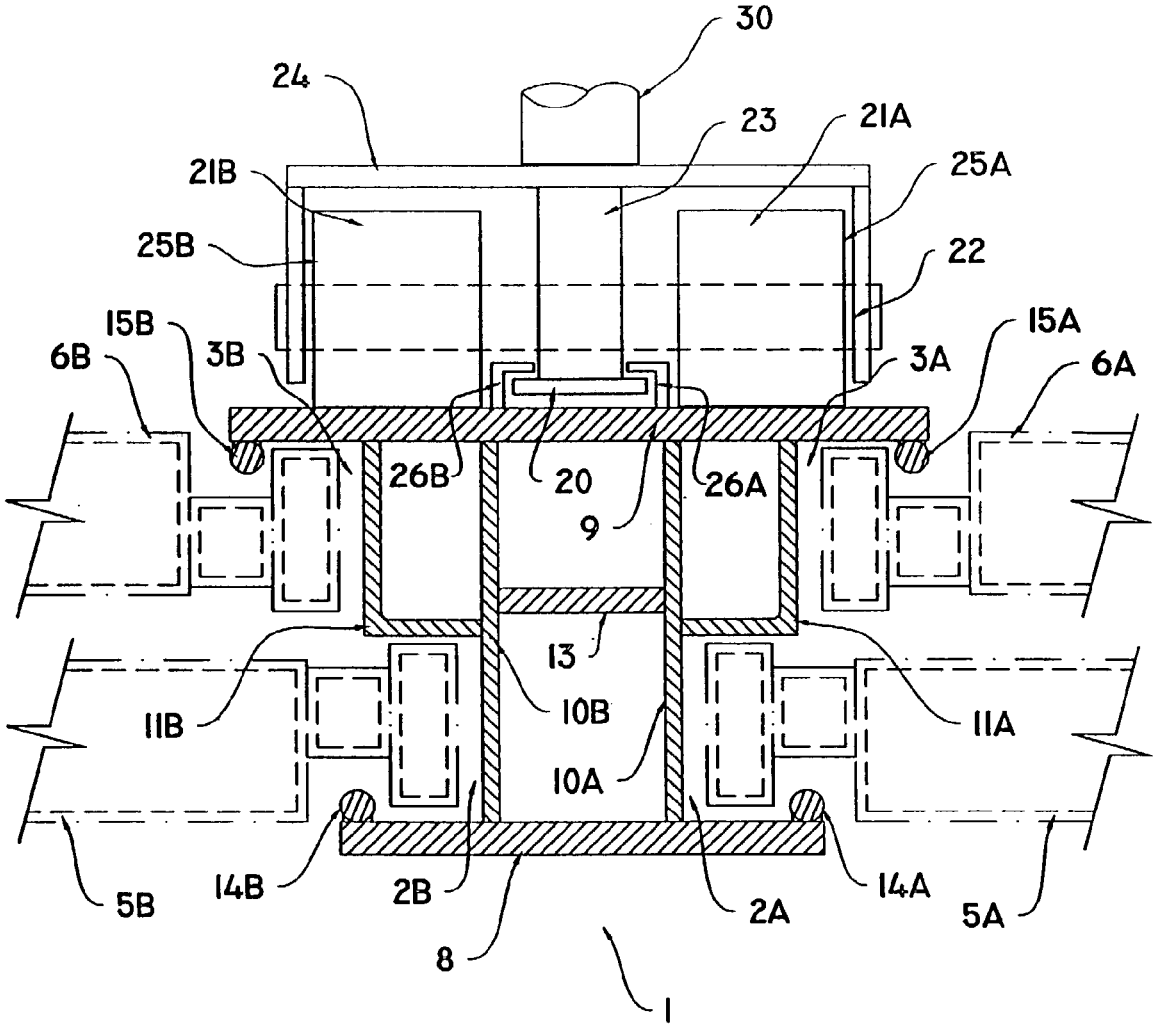
FIG. 3*a* is a schematic, top, fragmentary, sectional view of a linear rail post depicting another connection with the articulated truss.

Additionally, as shown in FIG. 3*a*, the channel for sliding connection between the articulated truss and the rail post could be exterior to the rail post and made by two angle pieces 26A and 26B.

Stepped Channel Structure Formed from Rectilinear Tubing

Figure 3B:
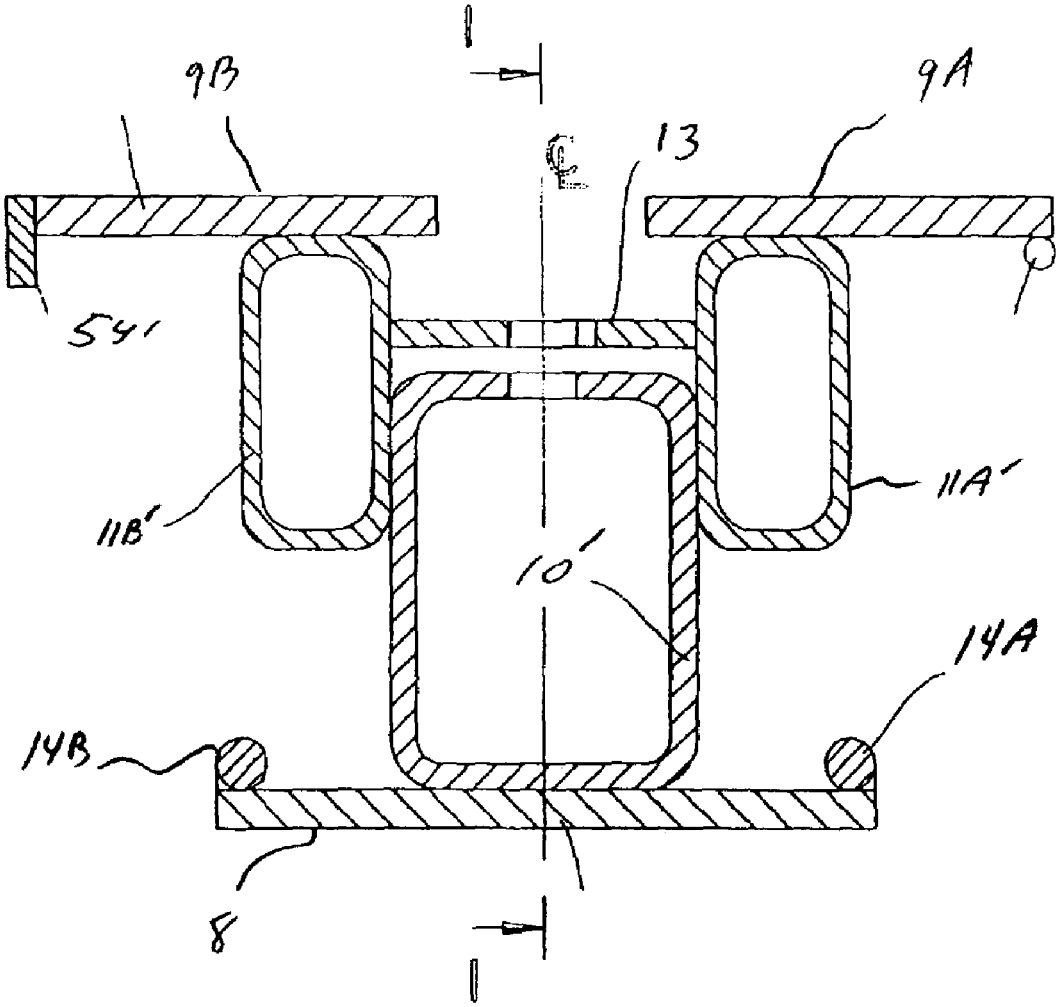
FIG. 3*b* is a sectional view of a vertical rail having a stepped channel structure formed from rectilinear tubing.
Figure 3B:
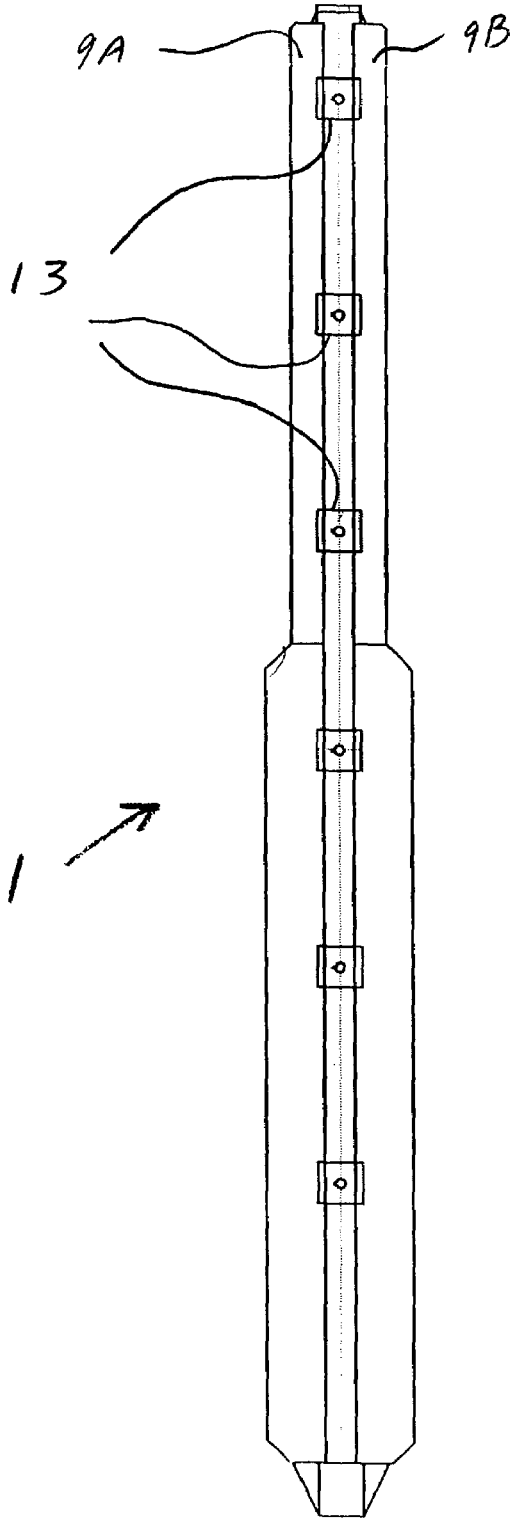
Figure 3B:
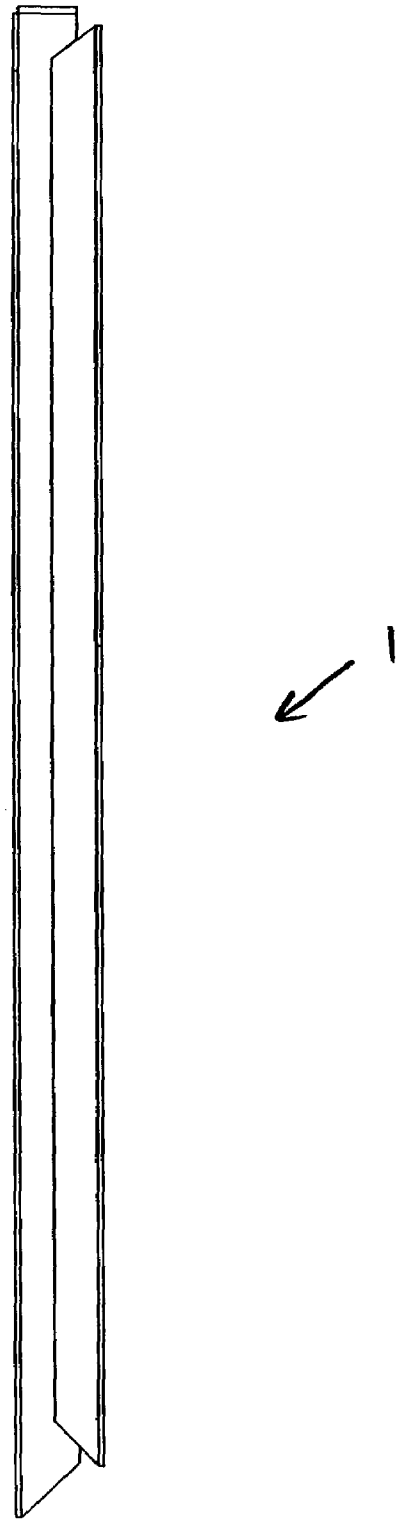

A cross sectional view of a variation of a linear rail post is shown in FIG. 3*b* comprising two rectangular tubes 11A', 11B' welded to a central rectangular tube 10'. In particular, one small tube is welded on each side of the central tube 10'.

Although the central rectangular tube is shown in FIG. 3*b* as being larger than the side rectangular tubes, it need not be. The central tube may be smaller than the side or ancillary tubes. Also, the central and side tubing may have another cross sectional shape such as, e.g., square, rectangular, trapezoidal, etc.

The use of tubing (e.g., rectilinear tubing) provides certain design advantages including but not limited to: 1.) savings in manufacturing cost as less straight plates and channels need to be welded, 2.) structural rigidity, and 3.) consistency in dimensions/tolerances as tubes of metal are readily available at various standard dimensions. Such stock tubing requires little (or no) additional processing.

FIGS. 3*b*' and 3*b*" are front and side views respectively of a vertical rail post 1. The vertical post includes a plurality of vertically spaced plates 13 each having an aperture for receiving (or interlocking) with a pin member to lock a movable truss (or spreader) in place. Once a desirable position is reached, a pin or another fastener (not shown) may be inserted into apertures in the truss and vertical rail post, locking the truss in place. The plates 13 may be welded to the vertical posts. Also, the apertures may be drilled into the vertical posts.

Figure 3C:
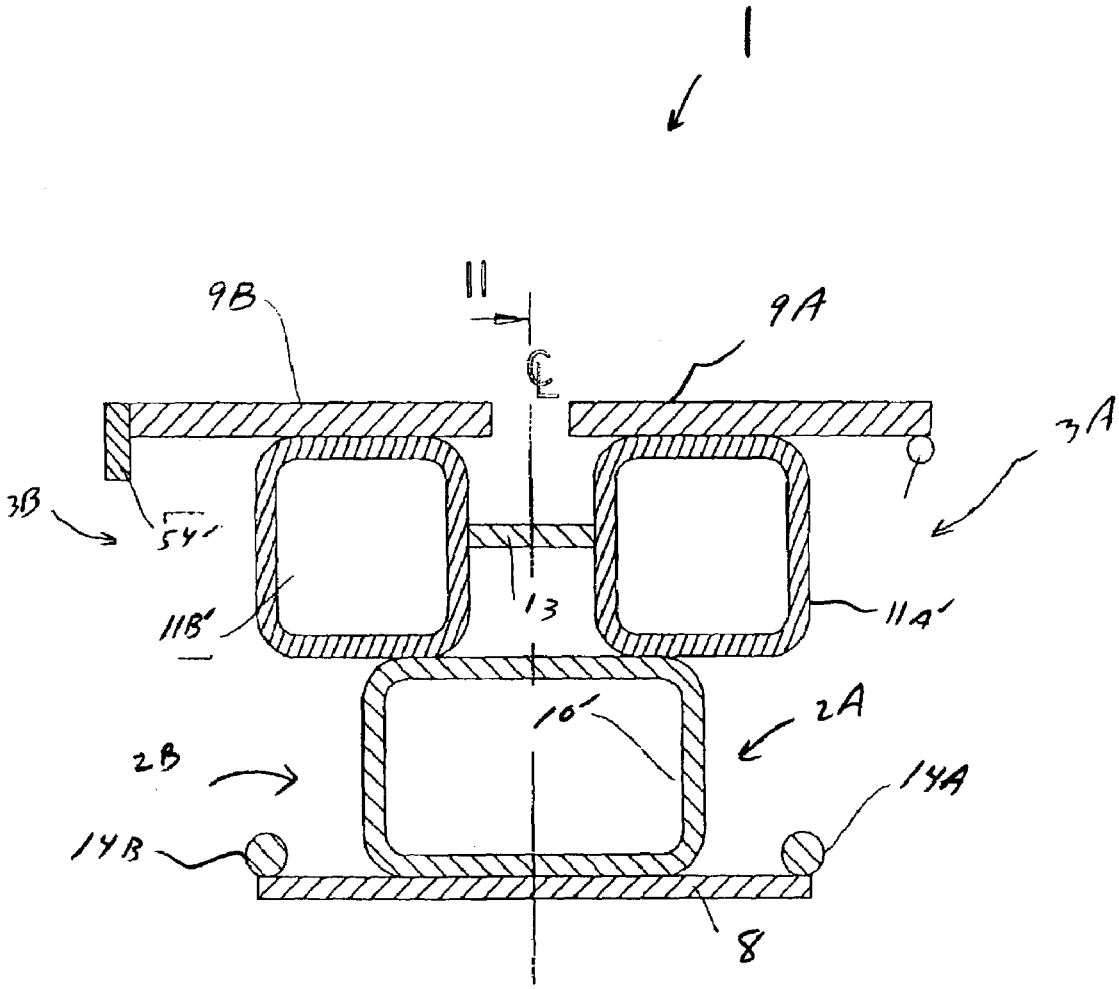
FIG. 3*c* is a sectional view of another vertical rail having a stepped channel structure formed from rectilinear tubing.

FIG. 3C depicts another variation of a vertical rail post having a stepped channel structure formed by rectilinear tubing. In particular, FIG. 3C shows two square (or another cross-sectional shape) tubes 11A', 11B' welded up-front a central rectangular tube 10'. Inner and outer wall panel guides are shown as reference numbers 3A, 3B and 2A, 2B respectively.

Stepped Channel Formed from Flange Having Two Bends

Figure 3D:
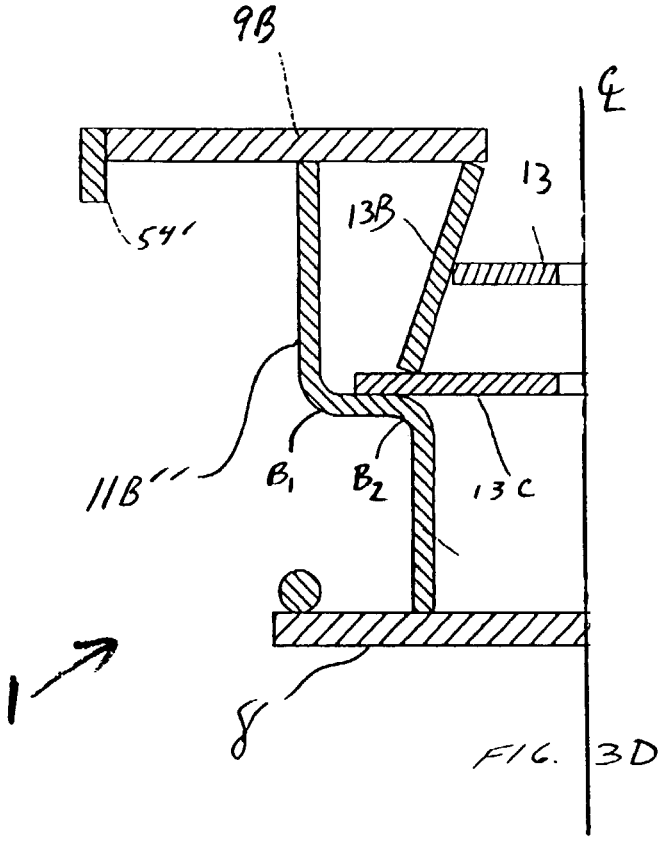
FIGS. 3D and 3E are partial sectional views of vertical rails having a stepped channel structure formed by flanges having two bends and an inclined support member.

FIG. 3D depicts a partial cross sectional view of another linear rail post 1 having a stepped channel structure. The opposing side shown in FIG. 3D includes two wall panel guides for slidably accepting an inner and outer wall panel. The inner and outer guides are formed by wall member (or 'flange') 11B" having two bends ($B_1$, $B_2$). The linear rail also includes several support pieces 13, 13B, and 13*c*. In FIG. 3D, piece 13B is shown inclined. These components may be welded together. Also, each component of the rail 1 may be symmetrical or nonsymmetrical about the center line (CL).

Figure 3E:
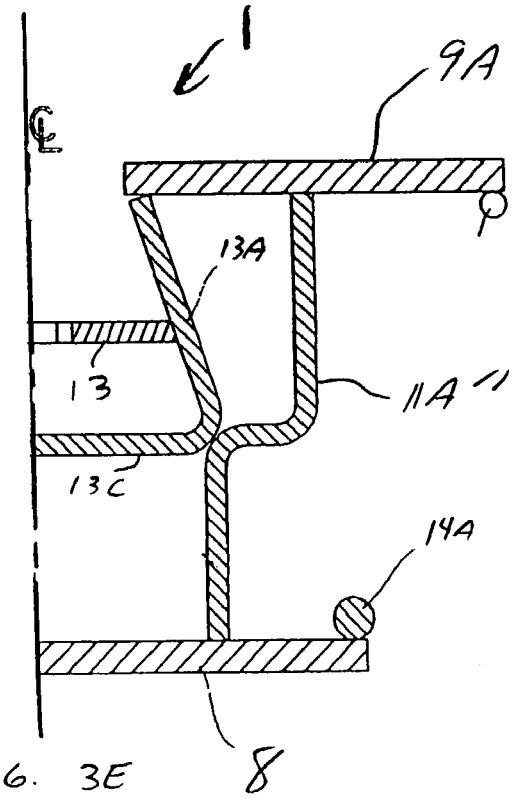

FIG. 3E depicts another partial sectional view of a stepped channel structure similar to that shown in FIG. 3D except that pieces 13A and 13C are integrated as one member. Also, pin holes or apertures may be included in the support members of the rail such that the movable truss may be pinnable to the linear rail post 1.

The components of the vertical rail 1 (e.g., pieces 13A, 13B, 13C) may thus be formed/welded in two different ways: 1.) they may be separately joined or 2.) they may be a single integrated member. Also, the features of the vertical rails shown in FIGS. 3D–3E may be symmetrical or nonsymmetrical about the center line (CL). Indeed, the opposing pieces 13A, 13B may mirror one another. Also, pieces 13A, 13B may be inclined or not inclined.

Figure 3F:
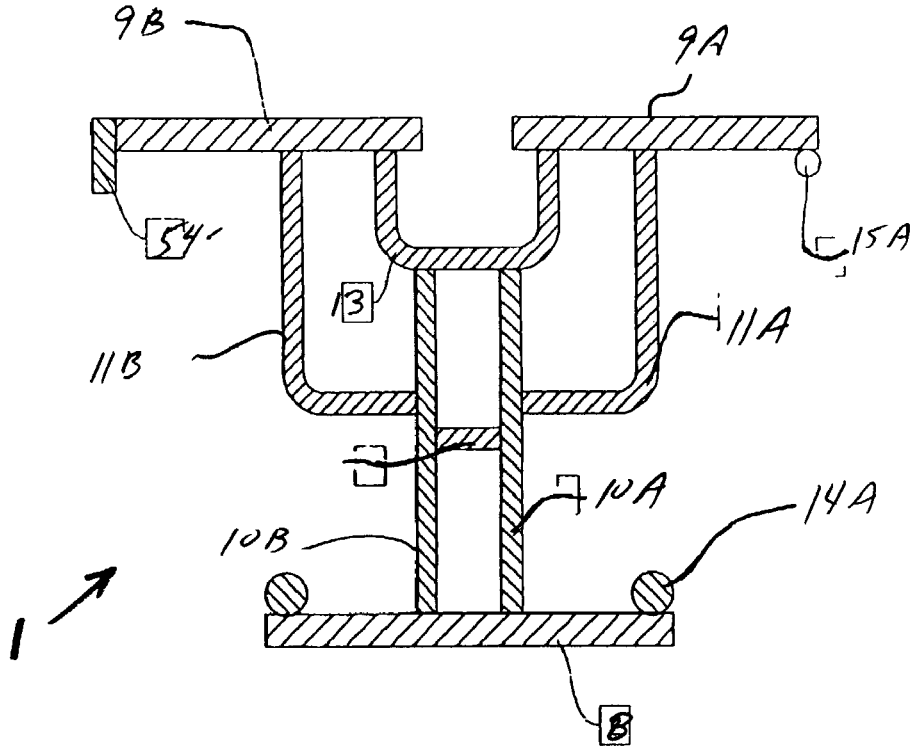
FIGS. 3F and 3G are sectional views of vertical rails having respectively U-shaped and circular-shaped truss guides for receiving and slidably engaging a movable truss.

FIG. 3F depicts a cross sectional view of another variation of a linear rail 1 having a combination of angle members 11A, 11B, and straight members 10A, 10B. Also, a channel member 13 is attached to the back surface of front plates 9A, 9B, providing a guide that slidably cooperates with the truss (not shown). This slidable cooperation between the rail and truss permits vertical movement while preventing horizontal movement.

Figure 3G:
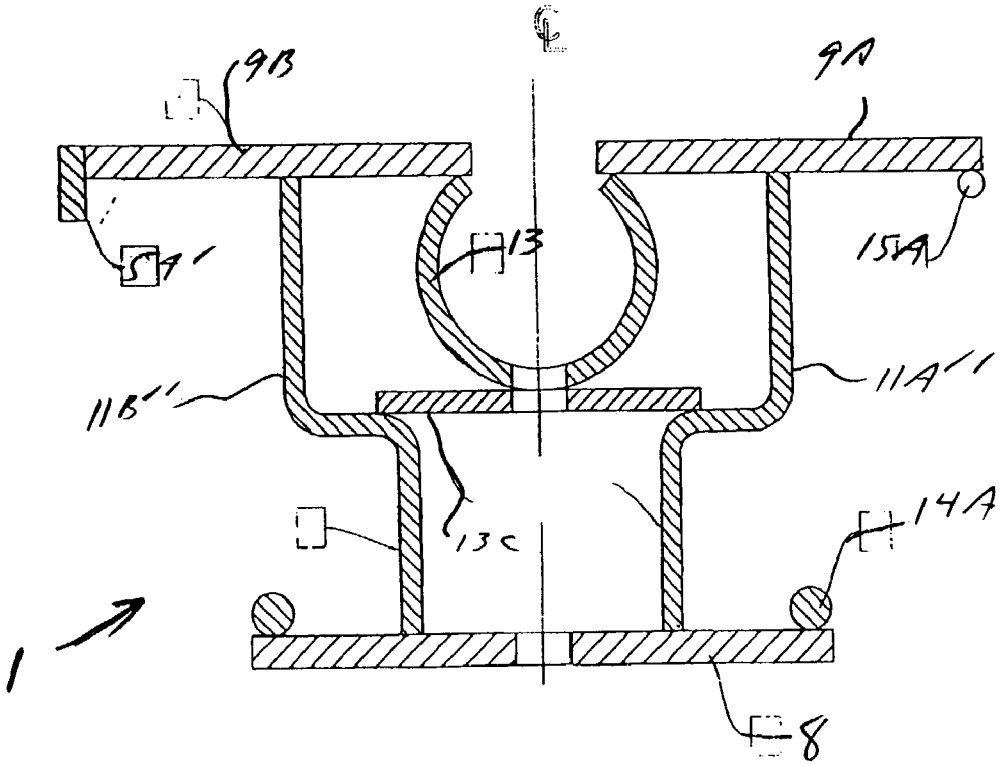

FIG. 3G depicts a cross sectional view of another linear rail similar to that shown in FIG. 3F but having a circular truss guide 13 for slidably receiving/engaging a vertical truss member. The circular guide 13 is situated between the front plates 9A, 9B and back plate 8. A support member 13C provides an attachment surface for the circular guide. The support member 13C is mounted to flanges 11A", 11B" at the stepped region.

Accordingly, a truss may be cooperatively engaged to the vertical rail post 1 via the circular guide 13. Also, as will be discussed further herein, the truss (not shown) may include rollers, facilitating its vertical movement along the rail post.

Figure 3H:
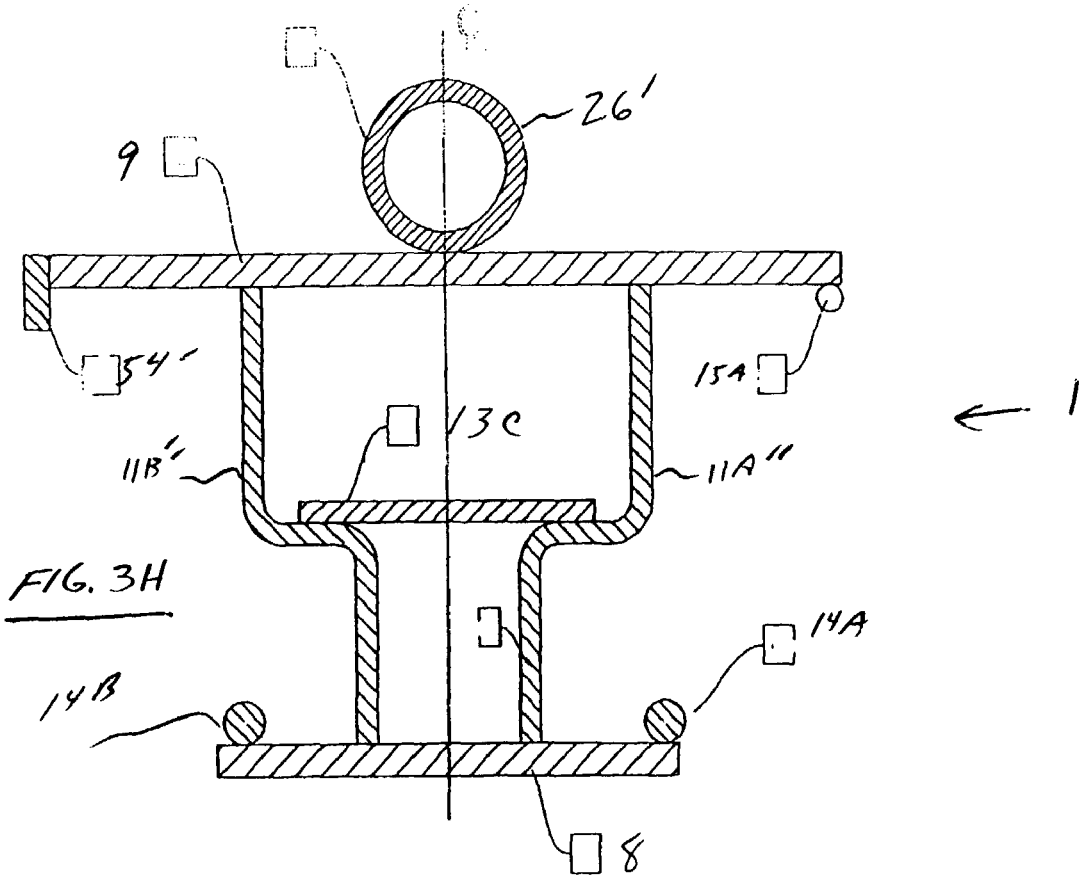
FIG. 3H is a sectional view of a vertical rail having a circular truss guide mounted on the exterior of the vertical rail.

FIG. 3H depicts a cross sectional view of another linear rail 1 having flange members 11A", 11B". A round truss guide 26' is shown mounted on the outside of the vertical rail. The truss guide 26' is mounted up-front front plate 9. The truss guide cooperates with a movable truss (not shown) to guide the truss vertically along the rail as described herein. The truss guide 26' may be mounted to the vertical rail by welding. The truss guide 26' may be a hollow tube, solid rod, or another type of member.

Although the channel structure shown in FIGS. 3G, 3H comprises flange members, it may comprise different or additional pieces. For example, flat plates, tubular sections welded together, channel members, angle members, or any combination of these pieces may be joined to provide the channel structure for slidably accepting the shore wall panels or the truss guide member.

Figure 3I:
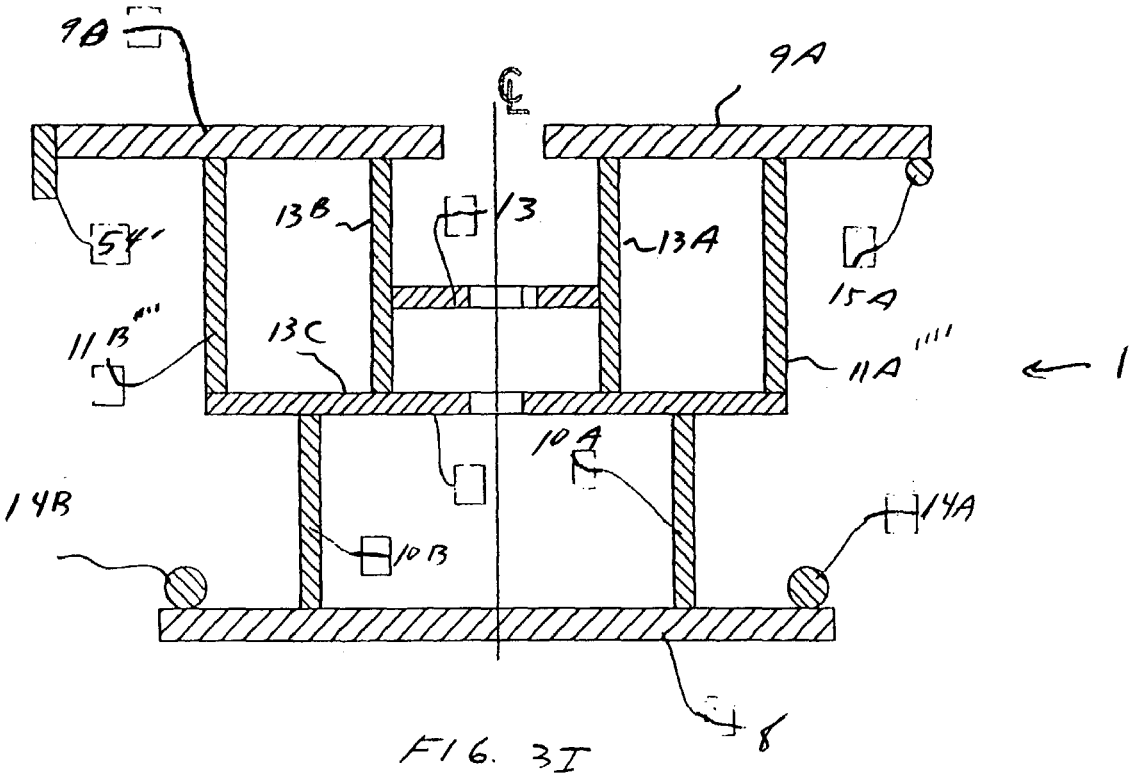
FIG. 3I is a sectional view of a vertical rail having a stepped channel structure formed from straight pieces.

FIG. 3I depicts a cross sectional view of another linear rail having a stepped channel structure. It is similar to that shown in FIG. 3F except that, unlike that shown in FIG. 3F, the linear rail post of FIG. 3I consists of straight pieces. In particular, the truss guide of FIG. 3I is formed by members 13, 13A, 13B. Members 13A, 13B are mounted on support plate 13C. Also, inner wall channel plates 11A"", 11B"" are mounted to support plate 13C. A pin hole is also provided in members 13, 13C for locking the truss in place once it is in a desirable position. The pin holes may be vertically spaced along the vertical rail as shown, for example, in FIGS. 3*b*', 3*b*".

Figure 3J:
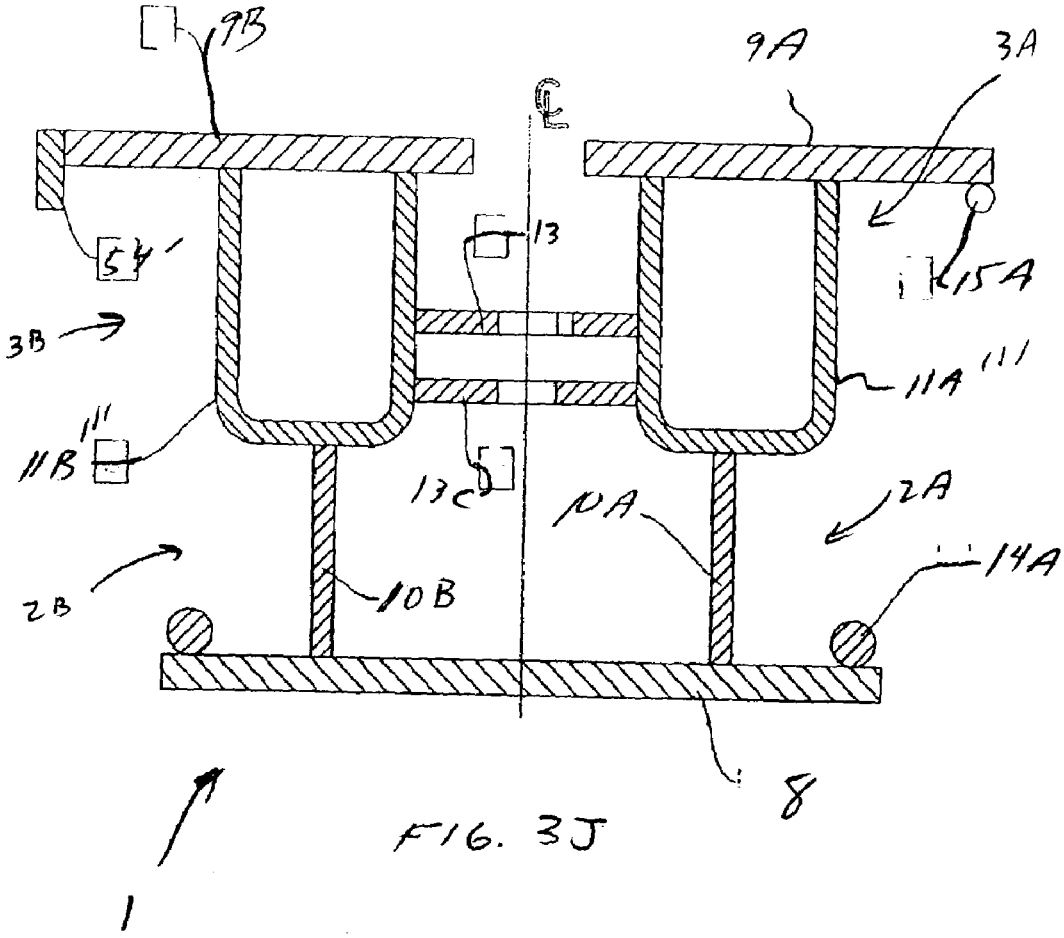
FIG. 3J is a sectional view of a vertical rail having a stepped channel structure comprising U-shaped channel members and straight plates.

FIG. 3J depicts a cross sectional view of another variation of a linear rail having a stepped channel structure. The inner wall panel guides 3A, 3B for the inner wall panels, however, are formed, at least in part, by U-shaped channel members 11'", 11B'". The outer wall guides 2A, 2B are formed by straight members 10A, 10B, back plate 8, and the U-shaped channels referred to above. The vertical rail shown in FIG. 3J additionally includes a truss guide situated within the vertical rail post (as opposed to outside the vertical rail as shown in FIG. 3H).

A magnetic bar 54' may be mounted on the vertical rail post 1 to help secure the wall panels. In particular, a magnetic bar 54' may be secured to a side of the front plate 9B to urge an inner wall into proper alignment as it is slid (and locked) into position. Also, the magnetic bars may be placed elsewhere in vertical rail to encourage interlocking between the various components of the shoring system.

Vertical Rail Posts Having Intermediate Panel Guides

Figure 4A:
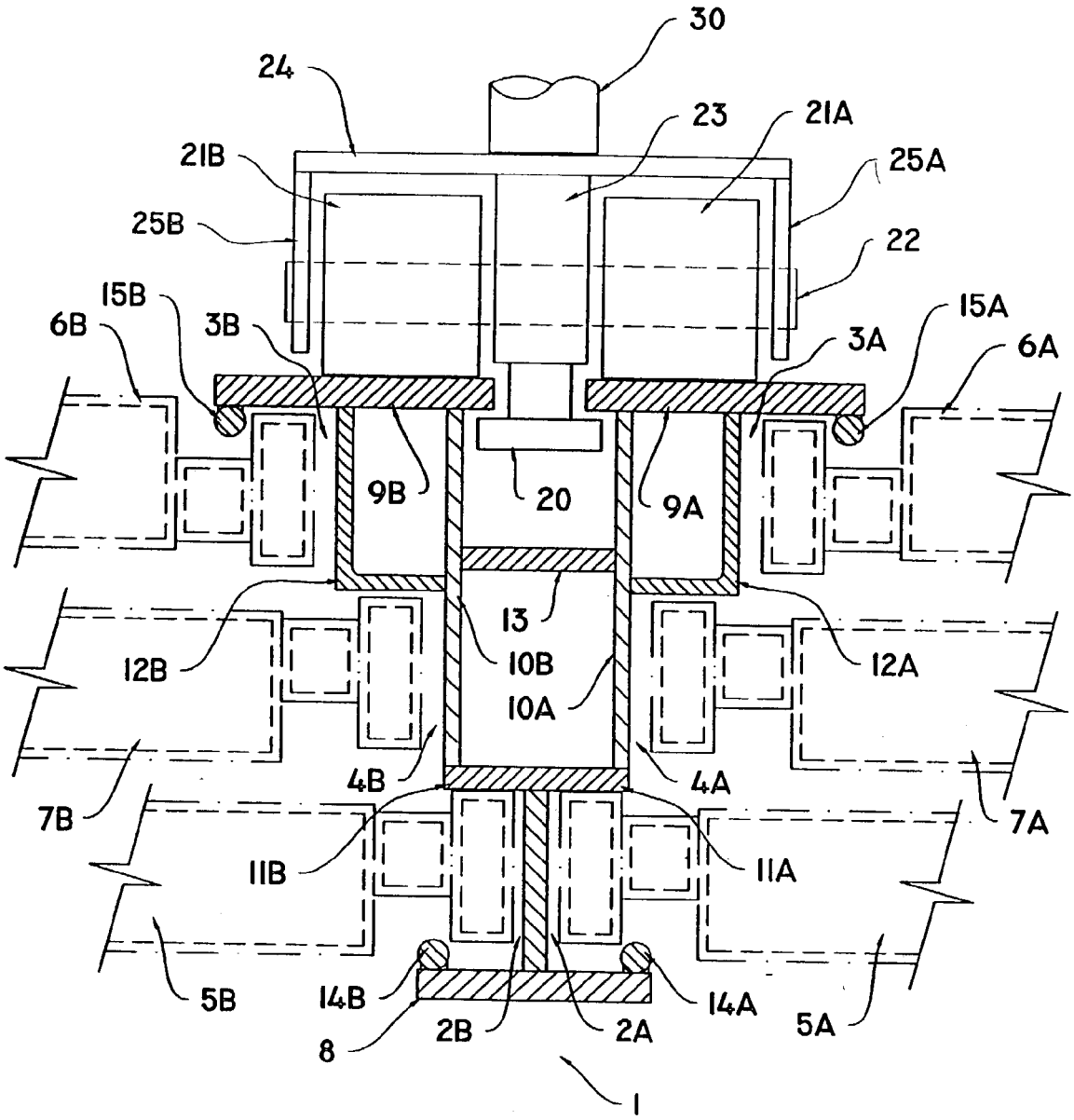
FIG. 4A is a schematic, top, fragmentary, sectional view of a linear rail post as shown in FIG. 1A, but with three guides for the panels on each opposing side.

As shown in FIG. 4A, the rail post 1 could have laterally intermediate panel guides 4A and 4B shaped respectively by the angle pieces 12A and 12B. Therefore, an intermediate shoring wall may be formed by the shoring panels 7A and 7B.

Figure 4C:
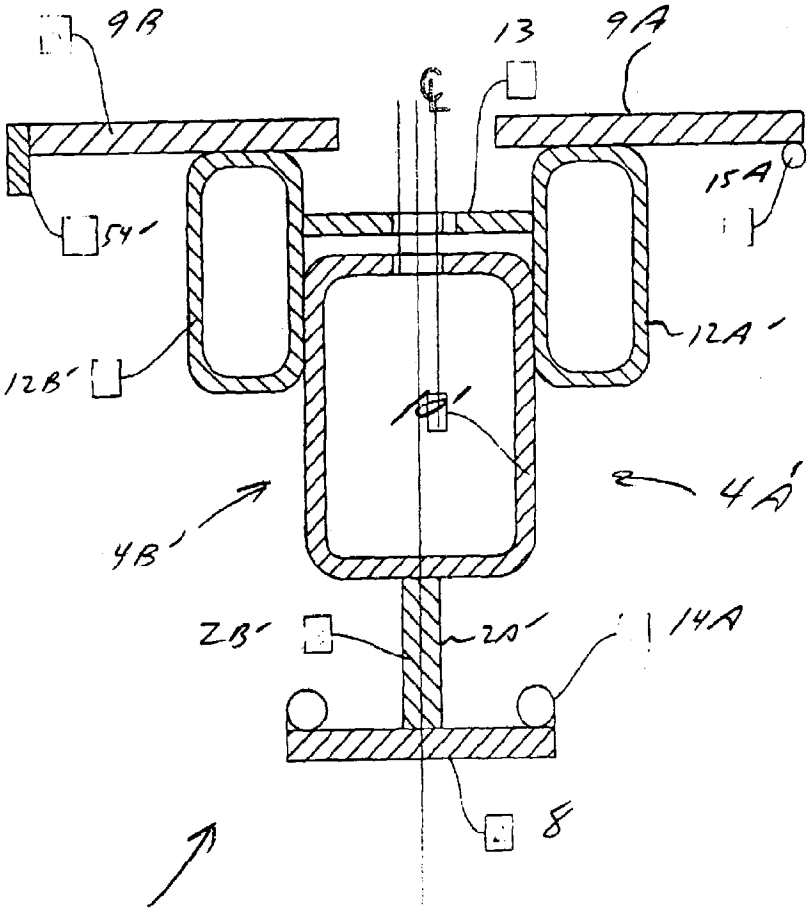
FIG. 4*c* is a sectional view of a vertical rail similar to that shown in FIG. 3B except the stepped structure shown in FIG. 4*c* can slidably receive an intermediate wall panel in addition to receiving inner and outer wall panels.
Figure 4B:
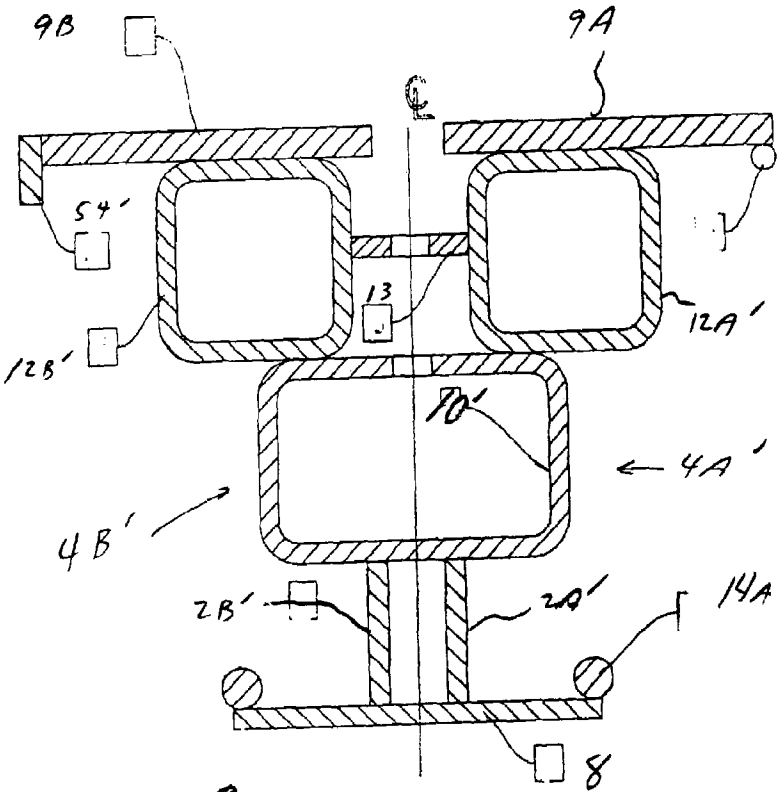
FIG. 4*b* is a sectional view of a vertical rail similar to that shown in FIG. 3C except the stepped structure shown in FIG. 4*b* can slidably receive an intermediate wall panel in addition to receiving inner and outer wall panels.

As shown in FIGS. 4*b* and 4*c* the rail post 1 may be comprised of tubular members to provide intermediate panel guides 4A' and 4B'. In particular, the linear rail shown in FIG. 4*b* includes two small square tubing members 12A', 12B' welded up-front a central rectangular tubing member 10'. The rail post additionally includes straight pieces 2A', 2B', providing guides for receiving outer panel members.

FIG. 4C shows a linear rail similar to that shown in FIG. 4B except that the smaller tubing members 12A', 12B' are mounted (e.g., welded) on the opposing sides of the central member 10'.

In each of FIGS. 4*b*–4*c* apertures are present in support pieces 13. The apertures are adapted to receive a portion of the movable truss (not shown) or a fastener that vertically locks the truss to the vertical rail.

Figure 4D:
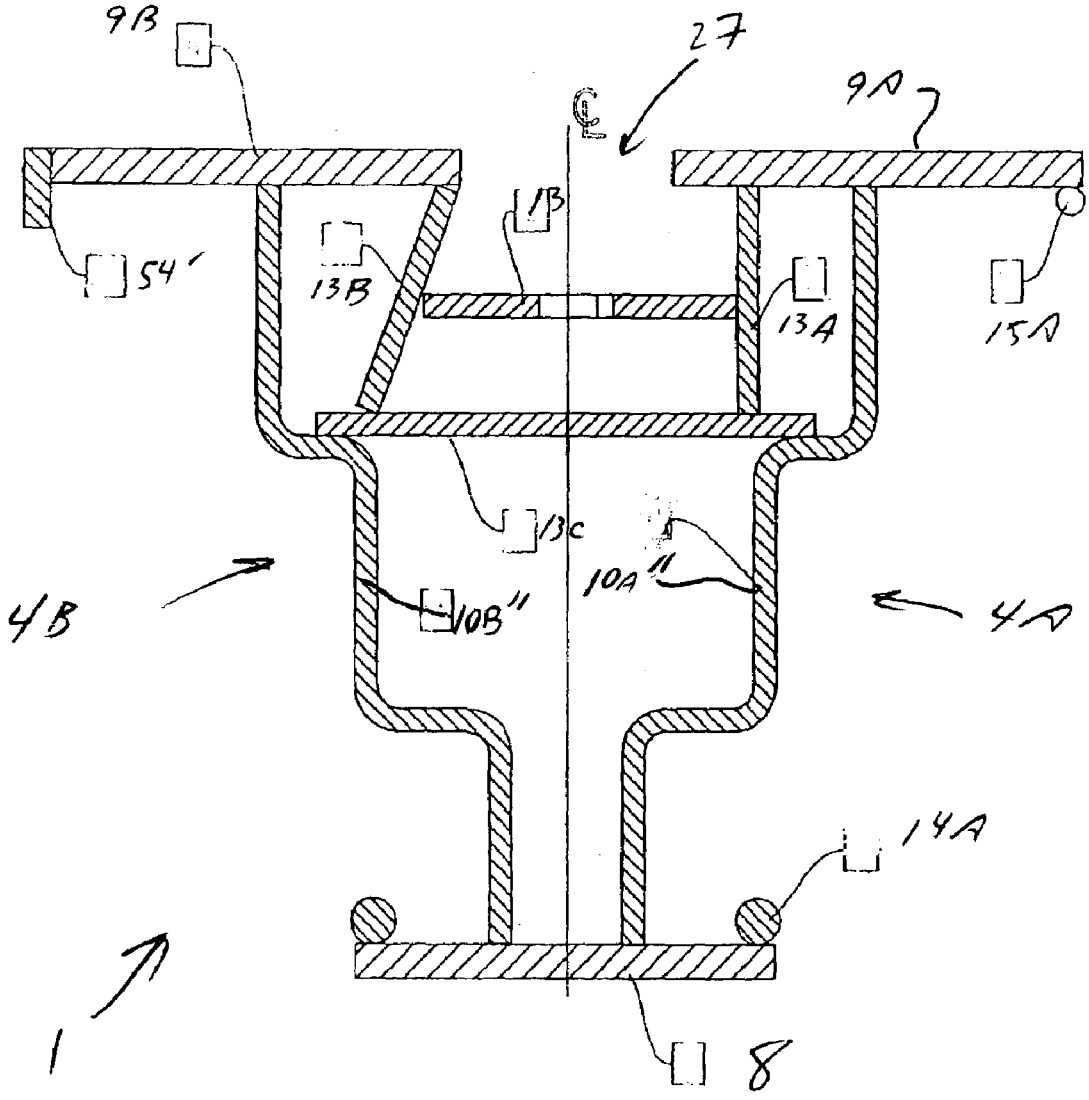
FIG. 4*d* is a sectional view of a vertical rail similar to that shown in FIG. 3D except that each flange shown in FIG. 4D includes four bends such that an intermediate wall panel may be slidably accepted.

FIG. 4*d* depicts a cross sectional view of another linear rail having a stepped channel structure. The vertical rail shown in FIG. 4*d* is adapted to receive an inner, intermediate, and outer wall panel on each side. This vertical rail also comprises flange members 10A", 10B" each having four bends, providing intermediate guides for engaging intermediate panels. Also, a pin hole is provided through member 13.

The vertical rail depicted in FIG. 4*d* also includes a truss member guide 27 for vertically engaging a movable truss (not shown). The truss guide 27 is formed by straight plates 13A, 13B, 13, 9A, and 9B. Although straight plate 13B is shown inclined, it need not be. Also, one or more of the other plates may be inclined or mounted at an angle. Also, a channel or angle member may be provided instead of individual straight plates to form the truss guide.

Corner Posts for Supporting Shoring Wall Panels

Figure 5:
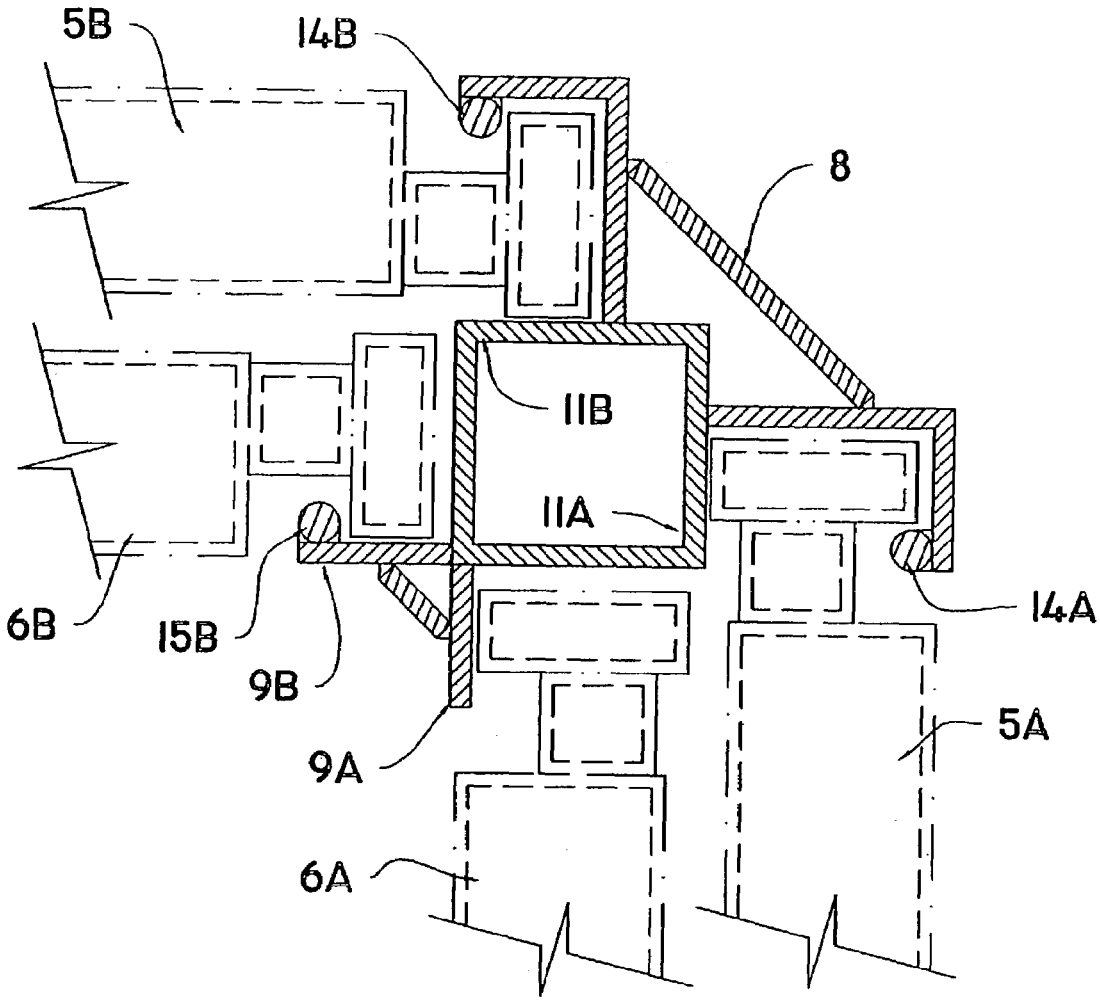
FIG. 5 shows a schematic, top, fragmentary, sectional view of a corner rail post, having guide channels oriented perpendicularly to each other for creating perpendicular shoring walls.

FIG. 5 shows a top fragmentary sectional view of a corner rail post for pit applications. Steps 11A and 11B are situated within perpendicular planes and allow panels 5A and 5B to slide and shape adjacent outer shoring walls. Likewise, the steps made by the pieces 9A and 9B hold the panels 6A and 6B of the inner shoring walls.

In a corner rail post, round bar 15 (A or B) is optional because the inner panels 6A and 6B block each other due to the load coming from perpendicular directions and the fact that the inner panel is installed after the outer one.

Figure 6:
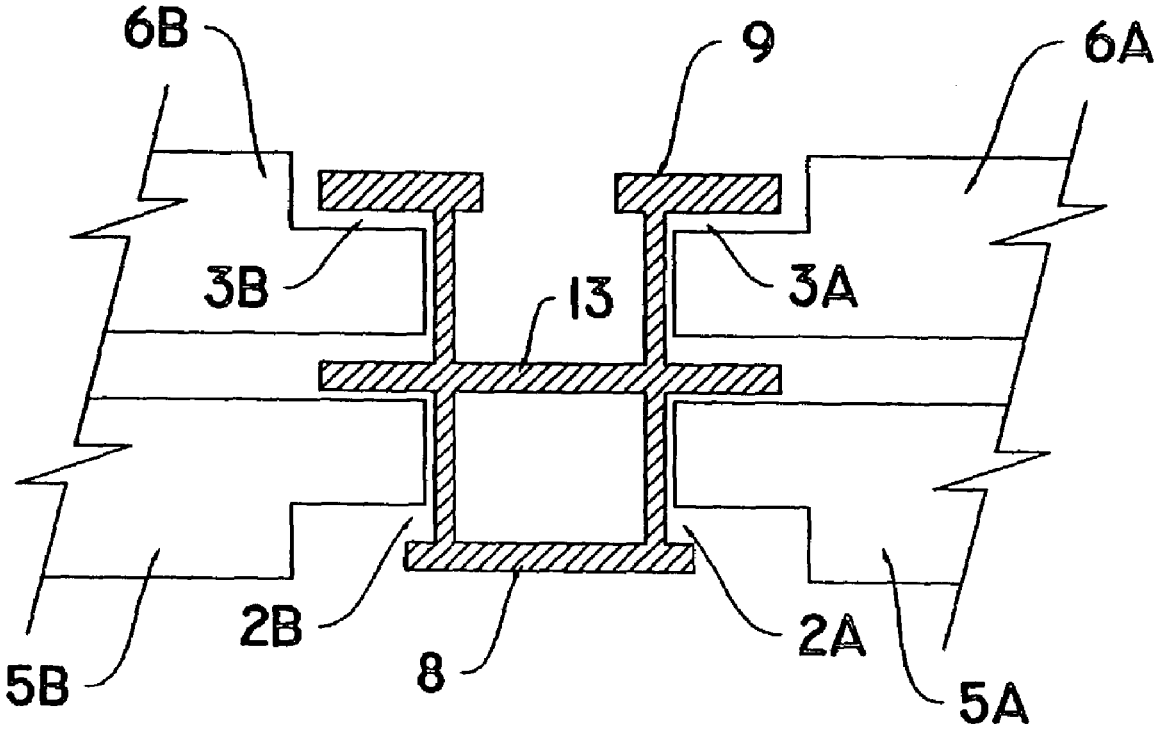
FIG. 6 is a schematic, top, fragmentary, sectional view of a linear rail post as shown in FIG. 1A, but depicting guide channels that are completely open for sliding the panels.

As shown in FIG. 6, channel guides 2A, 3A and 2B, 3B are used for guiding respectively panels 5A, 6A and 5B, 6B in the linear rail post, and may be completely open when using magnetic connections, or when not using magnetic connections. The panels may have the same length and mirror each other relative to piece 13. Also, magnetic and non-magnetic components may be incorporated into the channels to provide the cooperating engagement or connection.

Figure 7:
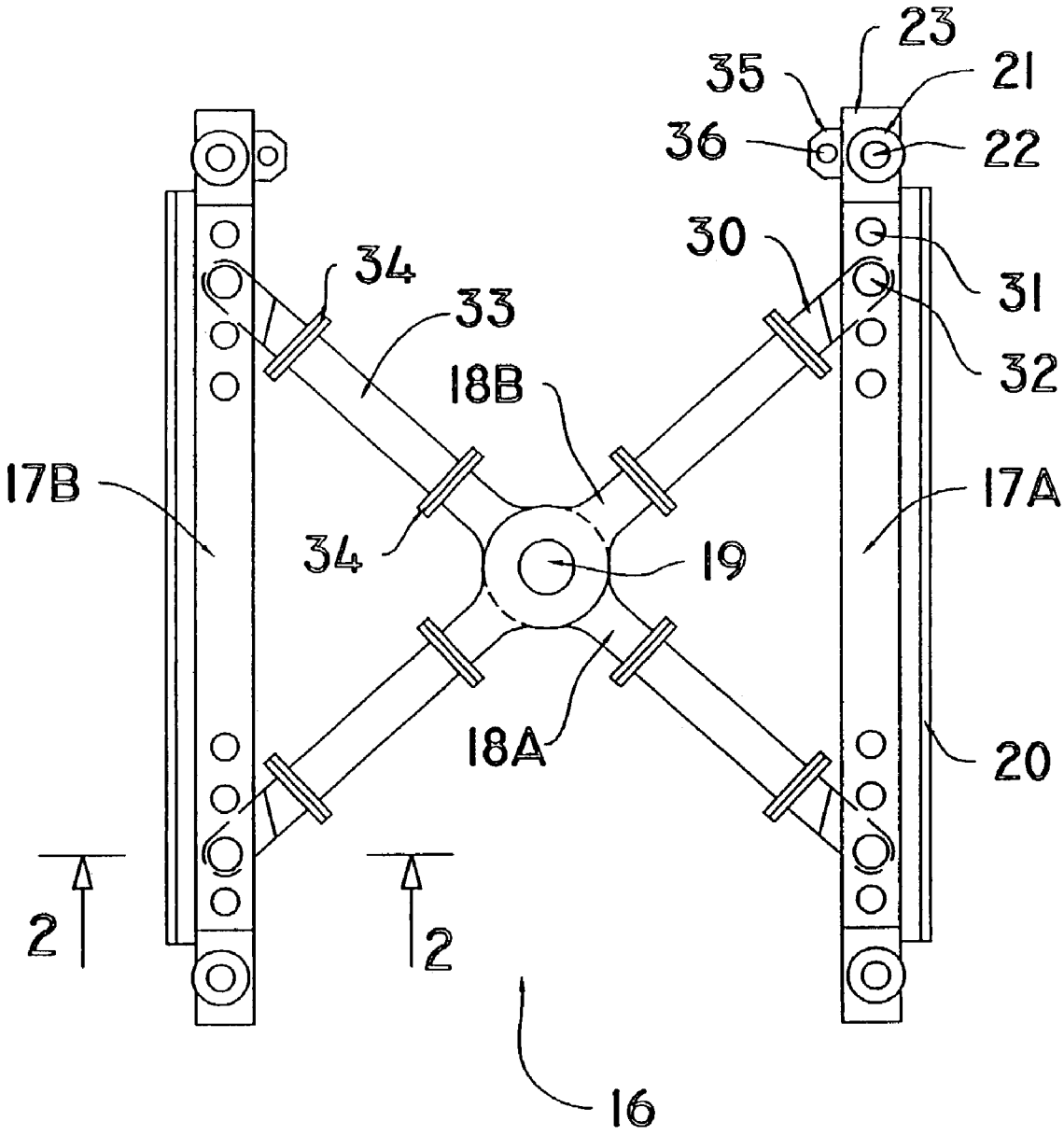
FIG. 7 shows a side view of the articulated truss similar to that shown in FIG. 1.

As shown in FIG. 7, an articulated truss 16 may have only triangular cells. The cross members 18A and 18B are connected to the vertical members 17A and 17B via the extension 33, flanges 34 and pin connector 30. The pin connector 30 is fixed in one of holes 31 by pin 32. For the same length of extensions 33, the width of the truss could be easily modified by moving the pin connector from one hole 31 to another one. The articulated truss may be manipulated by lifting holes 36 of edges 35.

Figure 8:
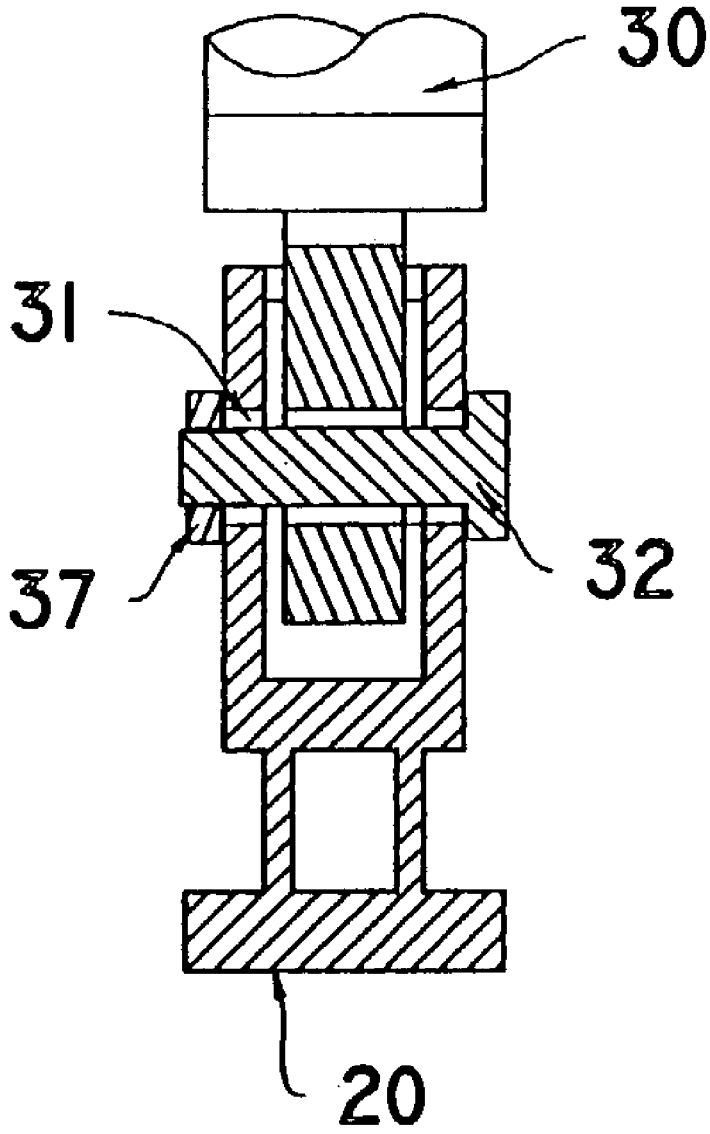
FIG. 8 is a sectional view taken along the line 2—2 of FIG. 7, showing the pin connections between cross and vertical members of the truss.

As shown in FIG. 8, a nut 37 secures pin 32 of the connector 30 to vertical member 17B.

Figure 9:
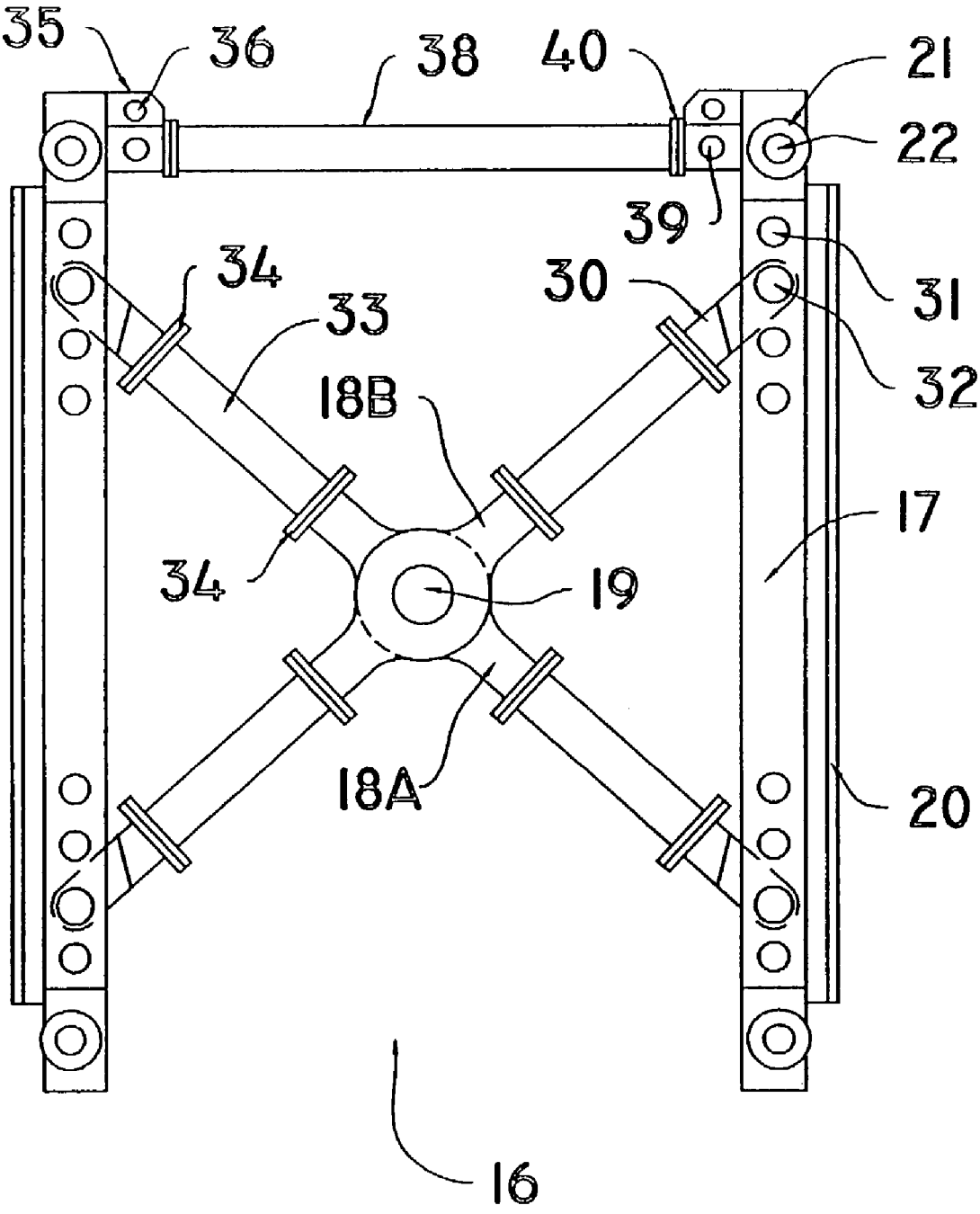
FIG. 9 shows a side view of the articulated truss having a horizontal strut connecting the upper part of the vertical members.

FIG. 9 shows a horizontal strut 38 used in combination with articulated truss 16. The strut 38 is connected to the vertical members of the truss via contact flanges 40 and pin 39.

Figure 10:
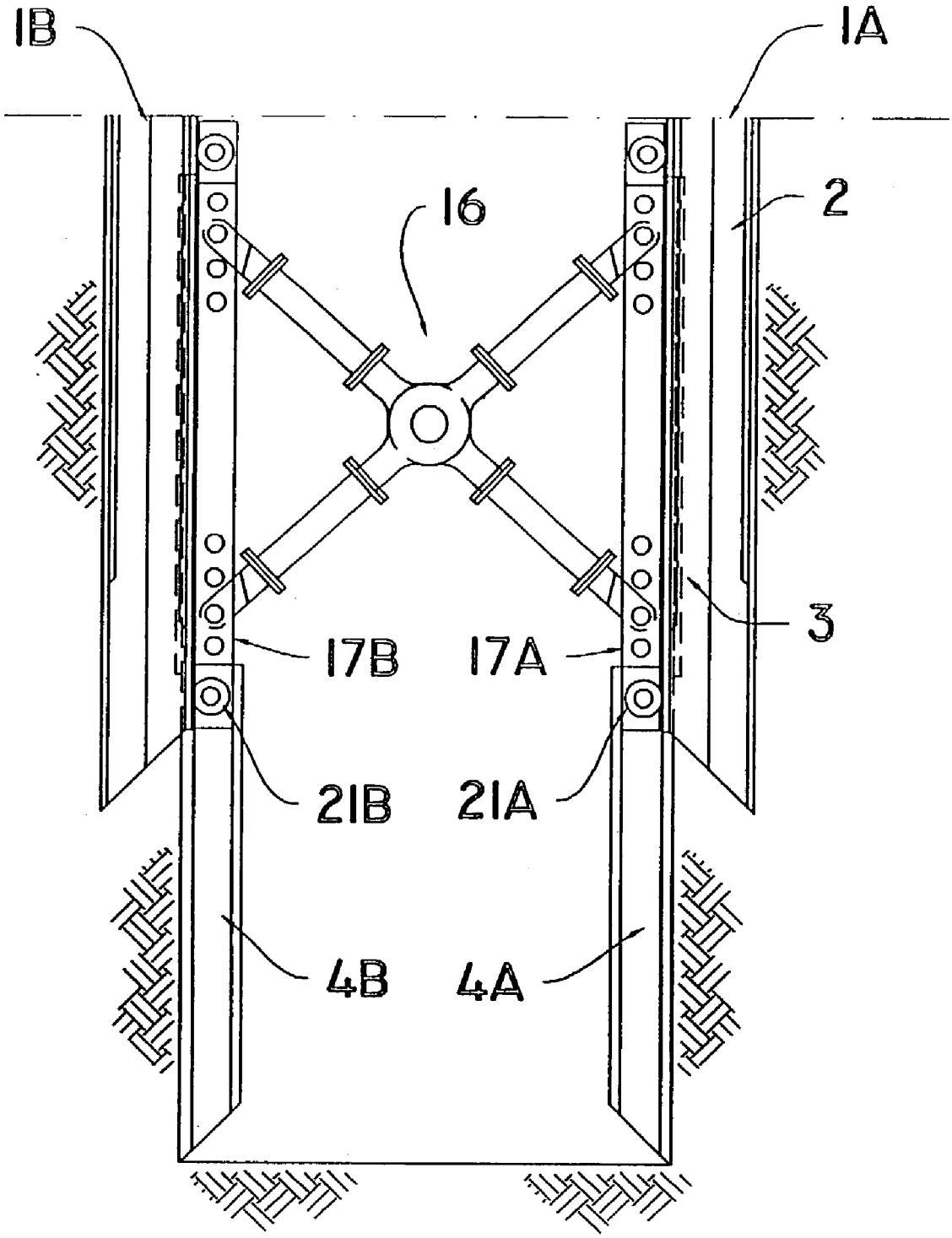
FIG. 10 shows a side view of an articulated truss wherein the vertical members have, on either side, guide channels for sliding additional panels.

Yet another type of articulated truss 16 is shown in FIG. 10, where vertical members 17A and 17B are extended way below the rollers 21A and 21B (collectively 21 in FIGS. 7 and 9) creating guides 4A and 4B for sliding additional panels in very deep excavations.

Shoring Wall Panels

Figure 11:
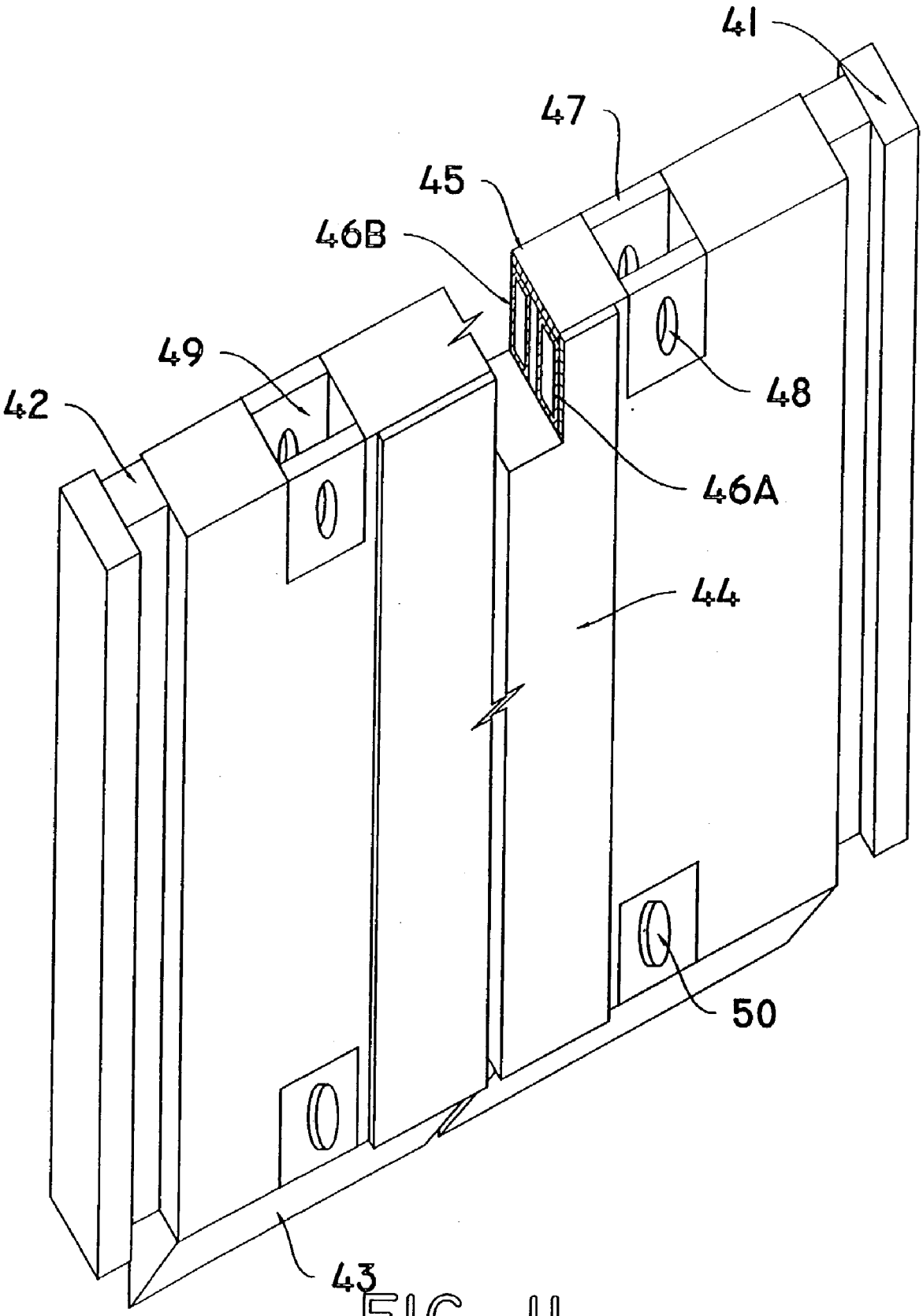
FIG. 11 shows a three dimensional view of a shoring panel.

As shown in FIG. 11, a shoring panel has guide members 41, 42 that slide inside the rail post guides, lifting plates 47 provided with a hole 48, and a cutting edge 43 fixed at the bottom by a pin or bolt through hole 50. To prevent damage to the panel, the upper part of it may be composed of two square tubes 46A and 46B slightly separated from each other and having a cover plate 45. The bottom and the top of the panel may be identical and the panel may be used in either position.

A thin flat plate 44 (a skin) may be affixed between lifting plates 47, 49 in the middle part of the panel only, to reinforce and reduce the bending of the panel due to the moment that increases parabolically from zero at its ends to a maximum at its middle. Additionally, the skin tends to protect the panel in the area where the bucket of the excavator is most active.

Figure 12:
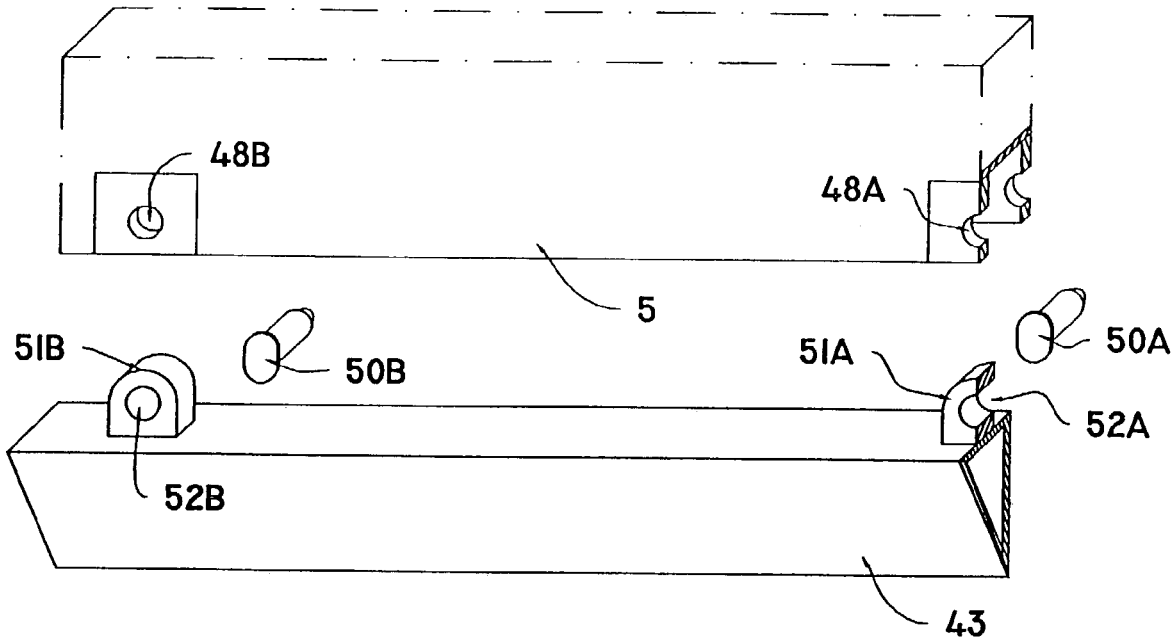
FIG. 12 is a partial three-dimensional view showing the connection of the cutting edge at the bottom of the panel.

The cutting edge 43 shown in FIG. 12, is pinned or bolted to the panel through holes 48A and 48B by the pins 50A and 50B via the plates 51A and 51B provided with holes respectively 52A and 52B.

Figure 13:
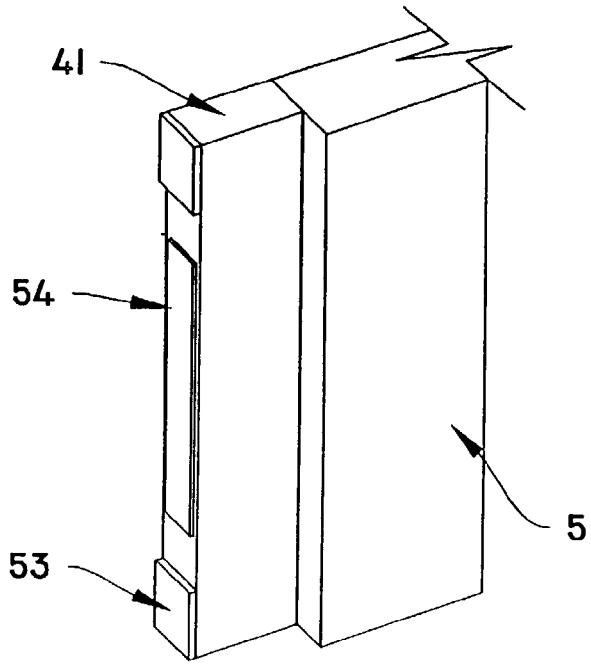
FIG. 13 is a three-dimensional view of the lateral end of a panel incorporating magnetic flat bars.

FIG. 13 illustrates another shoring panel 5 having a magnetic connection with linear and/or corner rail post by incorporating magnetic flat bars 54 on the sides of the panel guide 41. To prevent damage to the magnetic flat bars, two plates 53 are fixed on the guide 41 to support the pressure of contact between post and panel.

Figure 14:
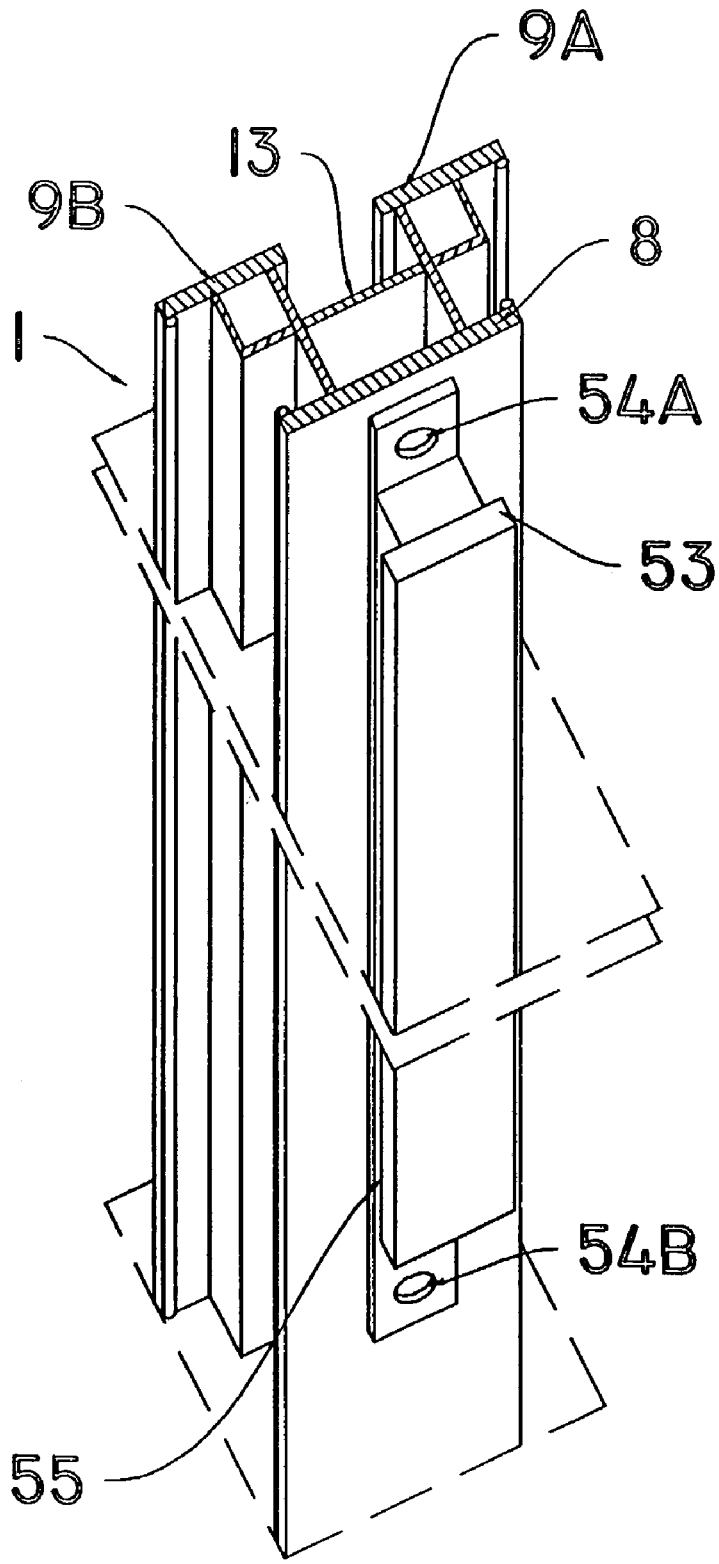
FIG. 14 shows a three-dimensional view of a sliding device fixed on the back of the rail post to slide formlockingly relative to another post.

As shown in the FIG. 14, a sliding device 55 may be fixed to rail post 1 by bolts through holes 54A and 54B and into holes in the back side of the rail post. This is desirable when the depth of excavation is great and there is a need to slide a pair of rail posts together. The sliding device 55 has a formlocking T shaped piece 53 that goes inside the 'C' channel in front of the other rail post identical to the 'T' shaped piece 20 of the articulated frame shown in FIG. 2.

Figure 15:
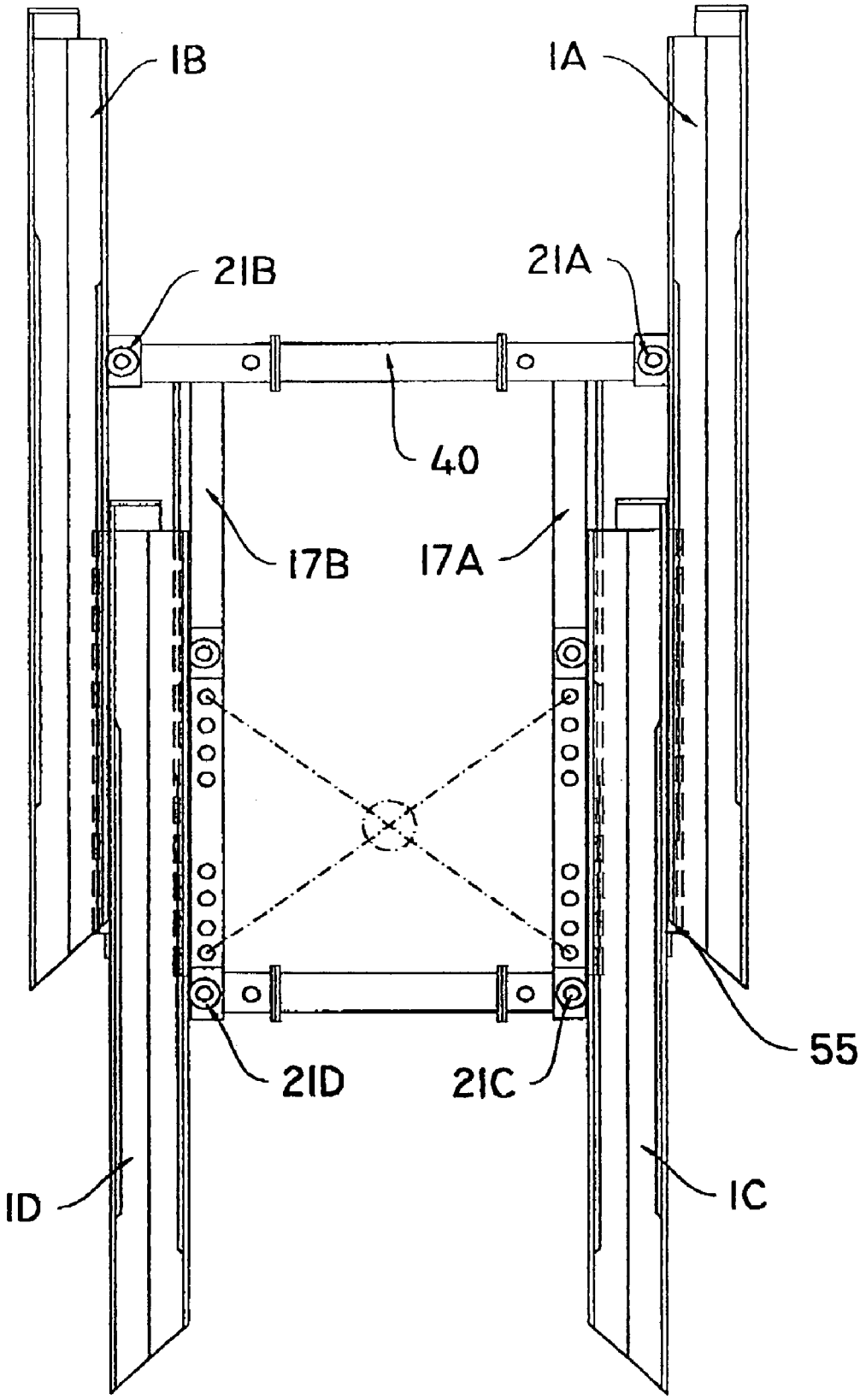
FIG. 15 shows a frame acting simultaneously on the upper and lower pairs of the rail posts.

As shown in FIG. 15, the truss supporting the twin pairs of rail posts acts simultaneously on the upper pair of rail posts, 1A and 1B, through the rollers 21A, 21B and on the lower pair of rail posts, 1C and 1D, via the rollers 21C, 21D. The truss could be an articulated type as indicated schematically by the dash-dot line or as a rectangular frame.

Figure 16:
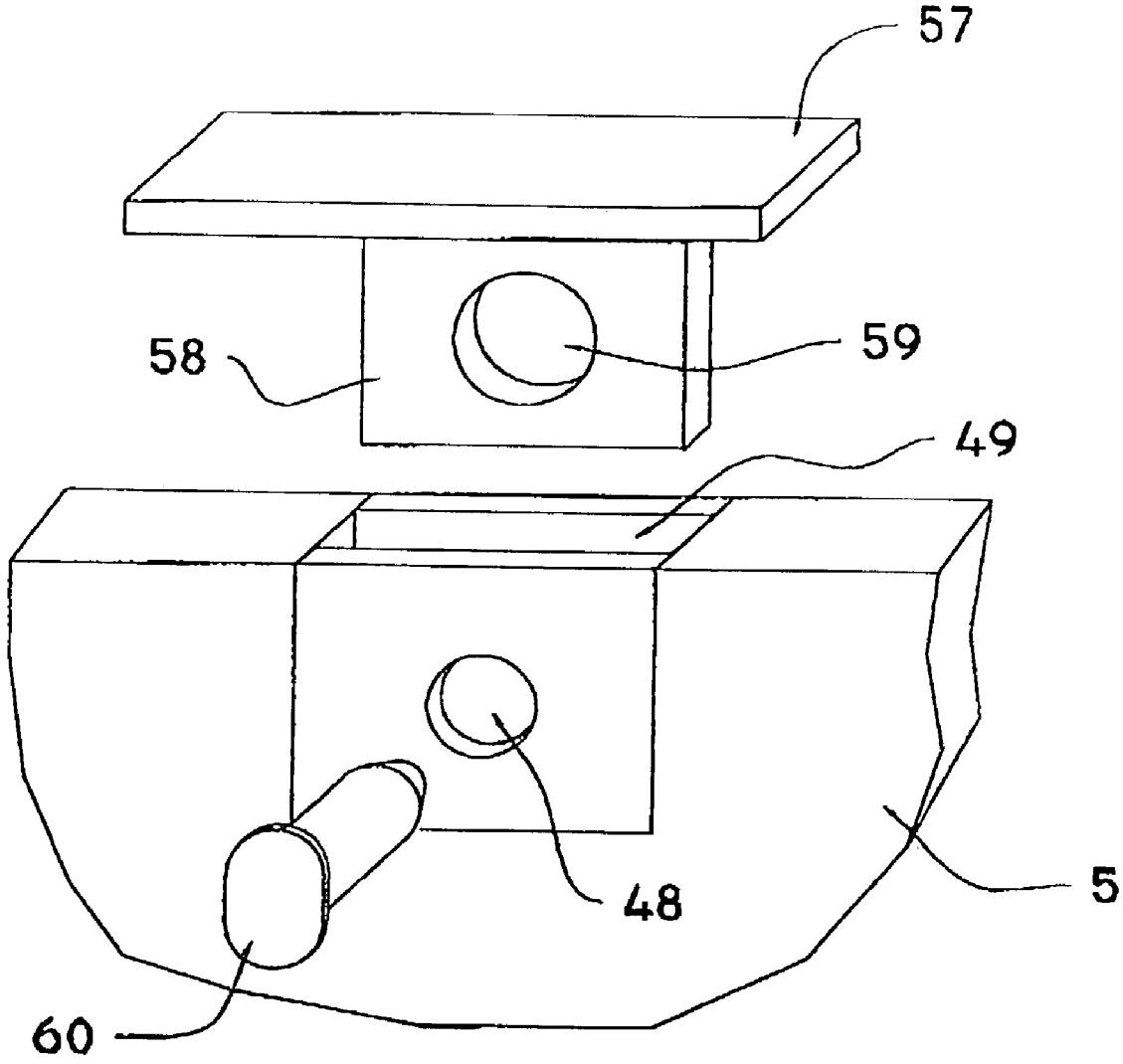
FIG. 16 is a three dimensional view of a hammering device to be affixed to the top of a panel for preventing damage to the panel during installation in the ground.

FIG. 16 shows another accessory device to be fixed on the top of the panel 5 to prevent damages during the installation of the system. The accessory device is made by welding together the two plates 57 and 58. The device can be pinned or bolted by the pin 60 passing through the hole 48 (passing through plate 49) and 59.

Vertical Rail Posts Having Round Truss Guide

Figure 17:
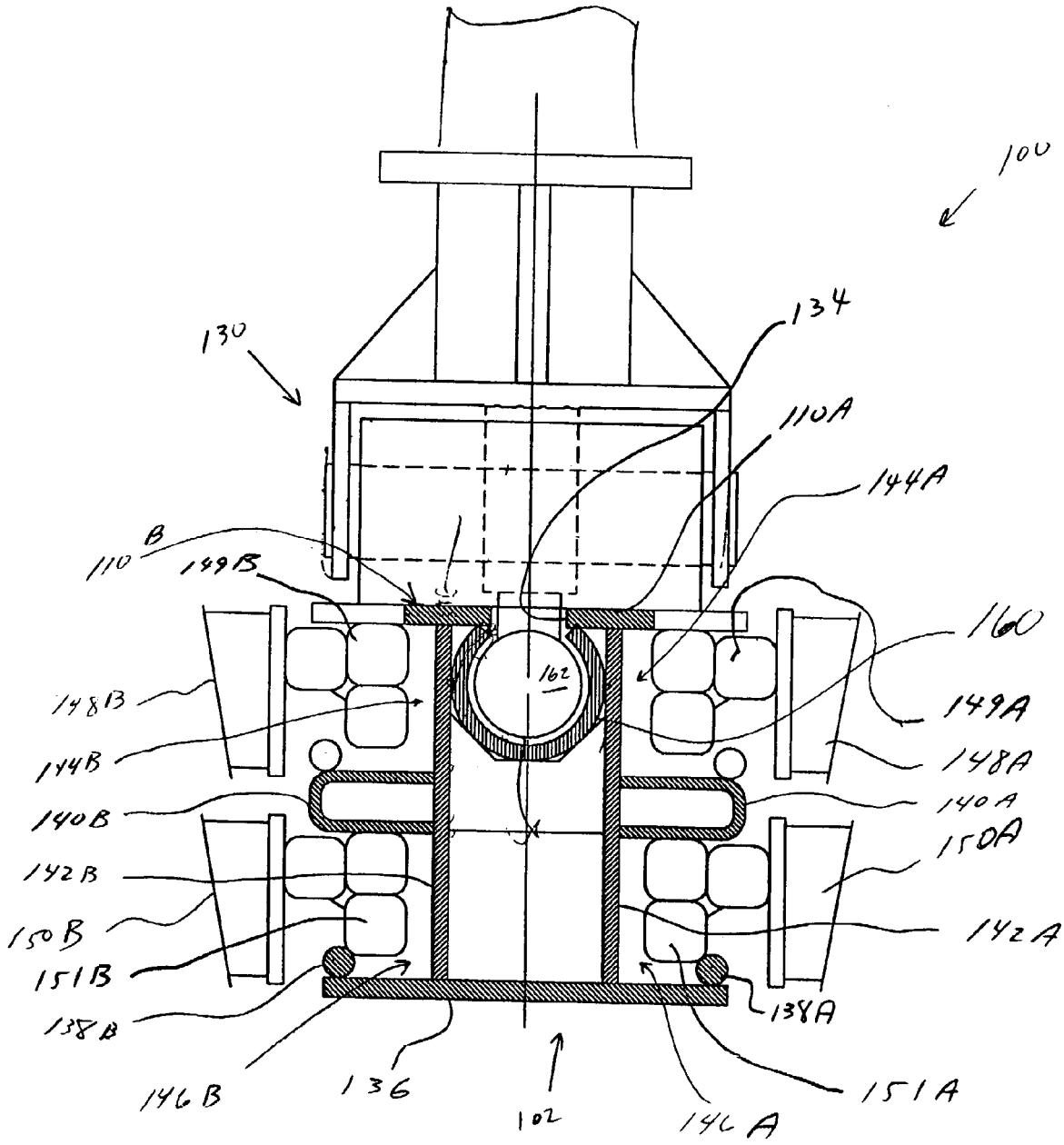
FIG. 17 is a schematic, top, fragmentary, sectional view of a vertical rail having a round truss guide.

FIG. 17 depicts a partial cross sectional view of a shoring system 100 including a vertical rail 102, inner wall panels 148A, 148B, outer wall panels 150A, 150B, and a mobile truss 130.

The vertical rail 100 includes a channel structure comprising opposing sides. Each opposing side includes inner wall panel guides 144A, 144B and outer wall panel guides 146A, 146B. The wall panel guides 144A,B and 146A,B slidably receive front wall panels 148A, 148B and back wall panels 150A, 150B respectively.

The guides are formed by channel members 140A, 140B and straight members 142A, 142B. Rod members 138A, 139B and 139A, 139B are mounted in the guides and extend vertically. The rod members interlock with the wall panel guide members (149A, 149B, 151A, 151B), locking the wall panels in position. The components of the vertical rail 102 may be welded together. The channel members 140A, 140B may be tubing or formed by joining (e.g., welding) straight members together.

Straight pieces 142A, 142B join the front plates 110A, 110B and back plate 136. Additional reinforcing/redundant members or pieces may be welded to further secure the components together (not shown).

As shown, the wall panel guides 144A, 144B and 146A, 144B slidably receive front wall panels 148A, 148B and back wall panels 150A, 150B respectively. Unlike the vertical rail posts described above, however, the channel structure shown in FIG. 17 is not stepped. The inner and outer wall panel guides 144A, 146A reside in the same plane. They also face the same direction. Consequently, the front and back wall panels may be the same length. This is an advantage since both the front and back wall panels may be made identical to one another, reducing the number of different types of components in the shoring system.

The vertical rail post 102 shown in FIG. 17 also includes a round or circular truss guide 160 for slidably engaging a truss member 162 of the movable truss 130. The truss guide 160 is shown behind front plates 110A, 110B. It is situated within the rail post 102. The truss guide member 162 of the truss 130 cooperatively engages the truss guide 160. The truss guide member 162 may be a rounded piece, tube, or rod attached to an end portion or extremity of the truss. The truss member 162 is slidably received by the truss guide 160, preventing the rod from being moved horizontally while allowing it to be moved vertically along the rail post. Of course, there may be some degree of angular slop or wiggle room between the mobile truss and the vertical rail.

The mobile truss 130 may include a frame and end assemblies. The frame may include one or more struts. It may be articulating or non-articulating. It may have a linear, rectangular, triangular, or other type of shape or cell shape. Each end assembly of the mobile truss preferably includes, as shown, one more rollers that contact the vertical rail post, facilitating vertical movement of the truss relative to the rail post.

Figure 18B:
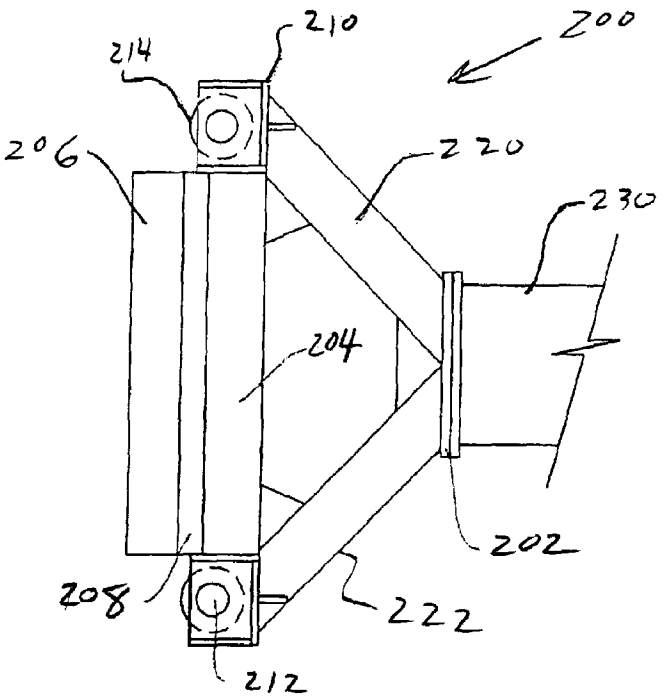
FIG. 18*b* is a side view of the spreader shown in FIG. 18*a*.
Figure 18A:
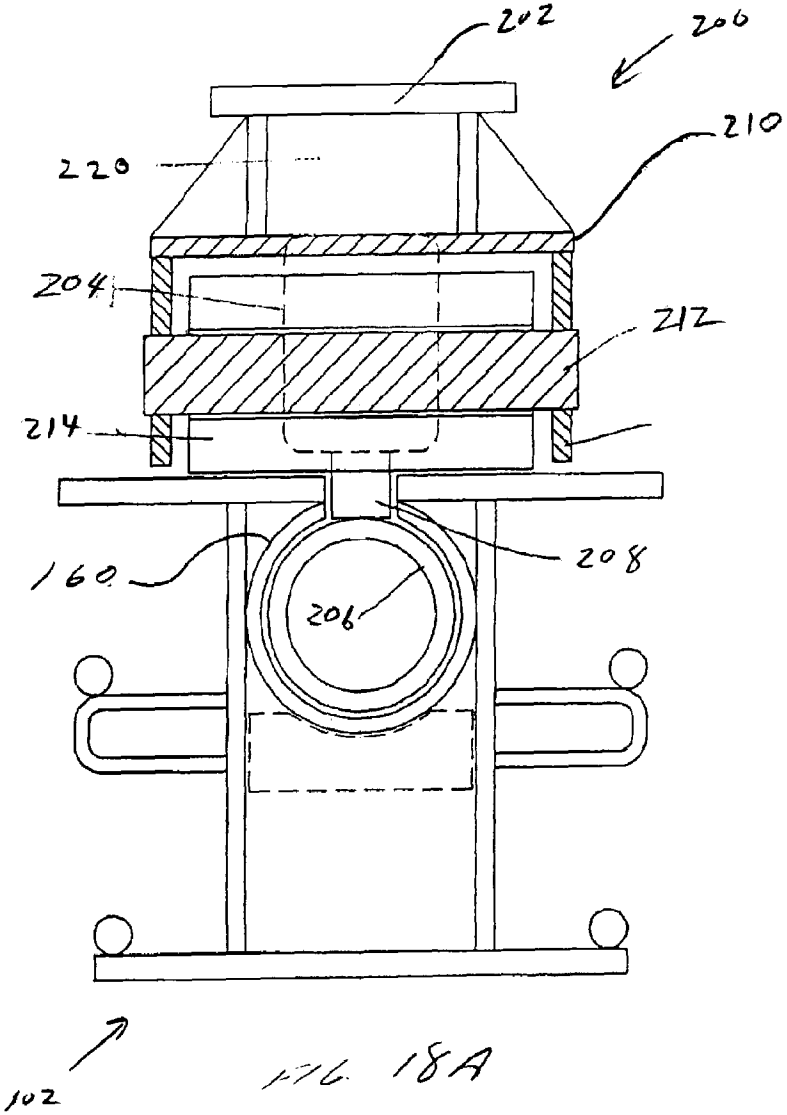
FIG. 18*a* is a schematic, top, fragmentary, sectional view of a rail post having a round truss guide cooperatively engaged with a mobile spreader (or truss).

FIGS. 18A and 18B, depict an end assembly 200 of a spreader cooperatively engaged with a vertical rail post 102. The vertical rail post is similar to that shown in FIG. 17. The end assembly of the spreader 200 includes a flange 202, rectangular tube 204, and vertical tube 206 that is connected to the rectangular tube 204 via member 208. Back supports 210 are also shown that support axle 212. A roller 214 rotates about axle 212. The roller 214 contacts the front plate of the rail post and facilitates movement of the spreader vertically. Although only one roller is shown per axle in FIGS. 18A and 18B, more than one roller per axle may be incorporated into the end assembly 200.

A side view of the spreader 200 is shown in FIG. 18B including an upper and lower beam 220, 222 to support an upper and lower roller assembly respectively. The upper and lower roller assemblies are further supported by rectangular tube 204. Additionally, flange 202 is shown mounted to strut 230. The strut may be configured to span across an excavation site to support vertical linear rail posts positioned opposite one another. The frame of the spreader or truss 200 may include one or more struts. The struts may extend linearly across the trench, form rectangular cells, triangular cells, or other cell types.

Figure 19A:
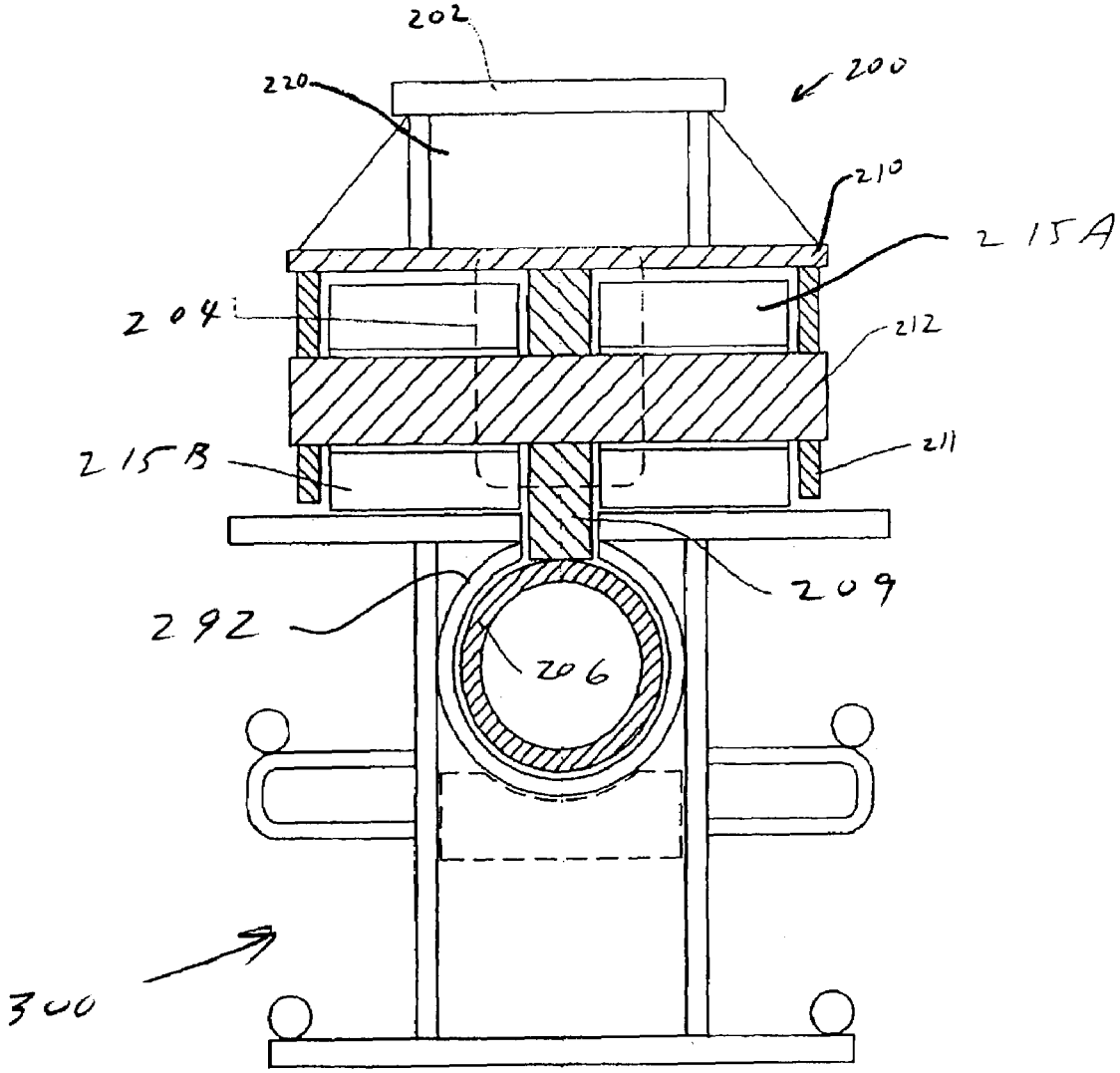
FIG. 19*a* is a schematic, top, fragmentary, sectional view of a rail post having a round truss guide cooperatively engaged with a mobile spreader (or truss); the spreader includes a pair of rollers per axle.
Figure 19B:
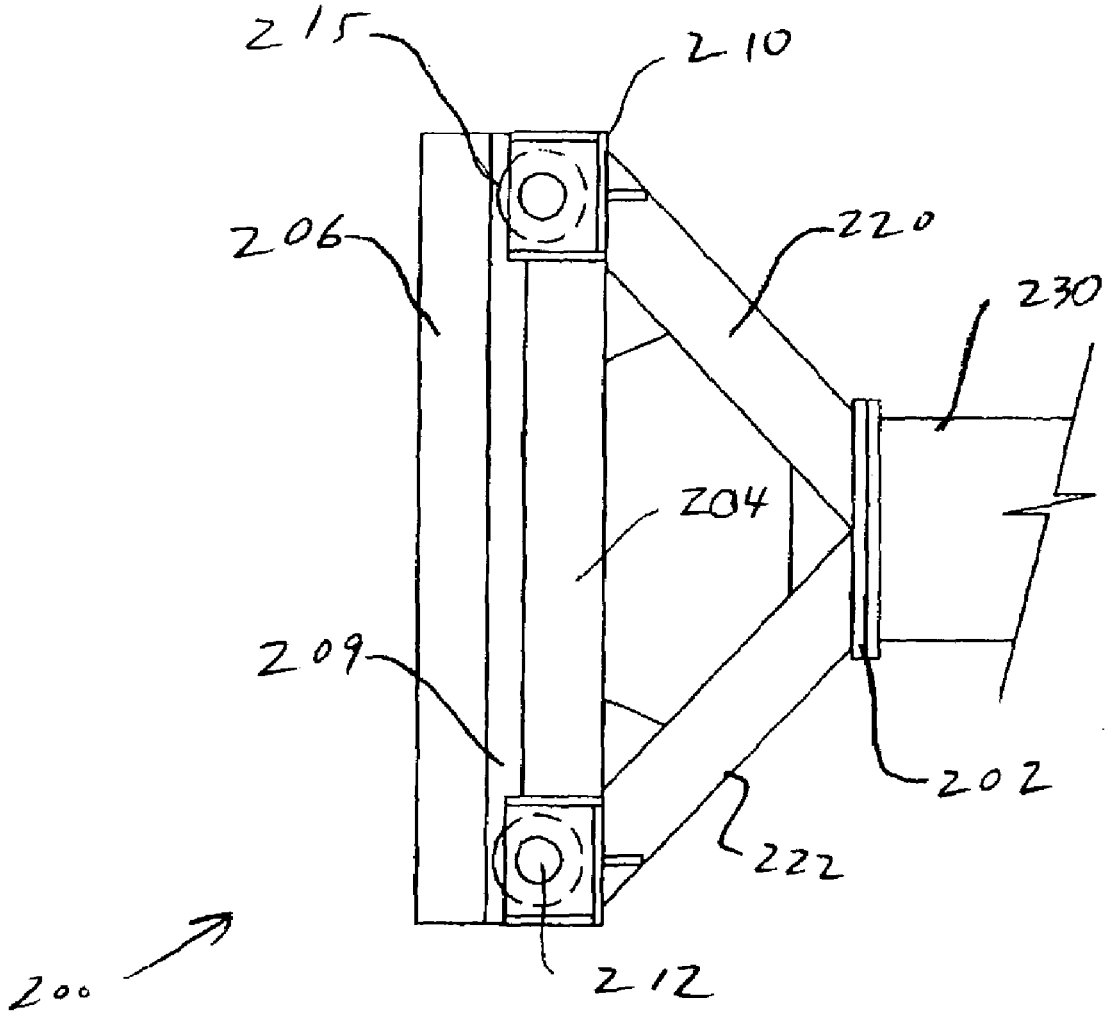
FIG. 19*b* is a side view of the mobile spreader shown in FIG. 19*a*.

FIG. 19A illustrates another partial cross sectional view of a shoring system similar to that shown in FIG. 18A except the end assembly 200 of the spreader accommodates two rollers 215A, 215B per axle 212. Also, as depicted in FIG. 19B, there is an upper set of rollers and a lower set of rollers.

The spreader 200 also includes a truss guide member 206. The truss guide member, as shown in FIG. 19A, may be slidably received by a truss guide 292 that is connected to the vertical rail post 300. The truss guide 292 may be a round tube. In the shoring system depicted in FIGS. 19A–19B, the truss guide 292 is disposed within the vertical rail. However, as discussed elsewhere in this application, the truss guide may be situated exterior to the vertical rail.

Figure 20:
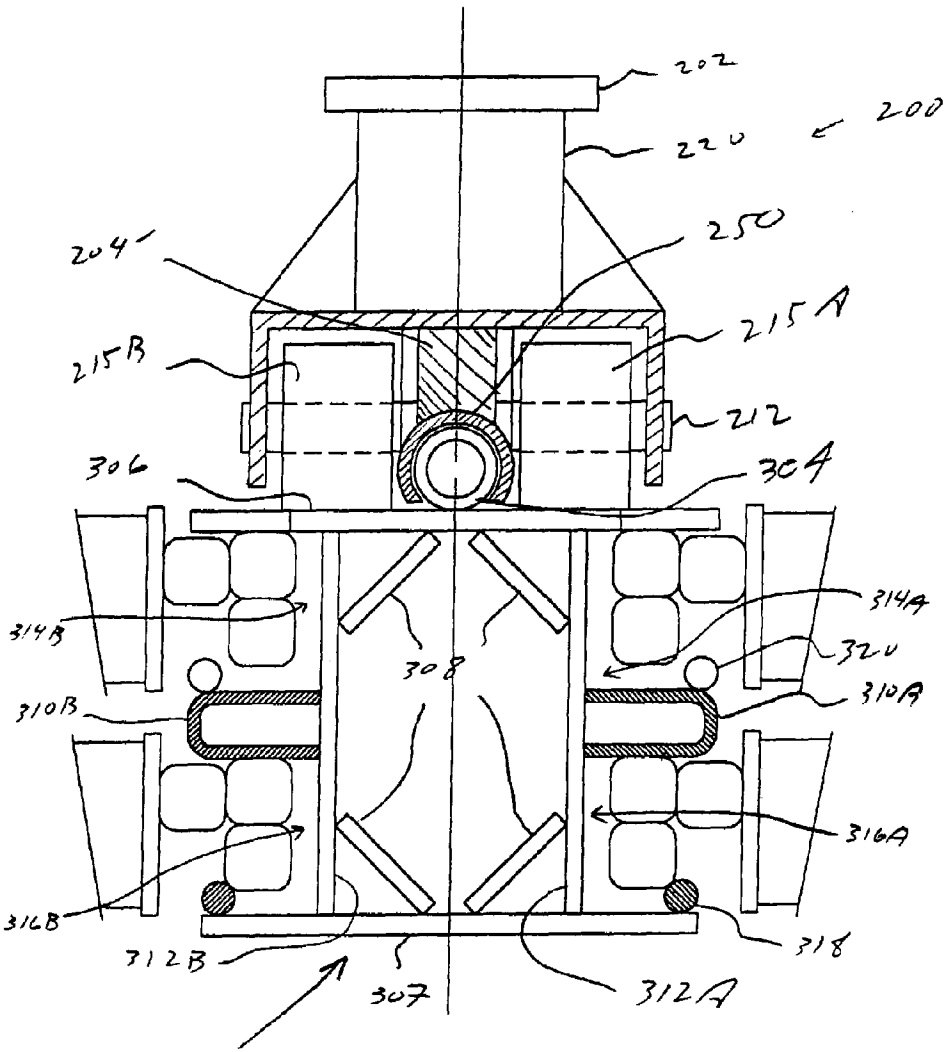
FIG. 20 is a schematic, top, fragmentary, sectional view of another rail post having a round truss guide cooperatively engaged with a mobile spreader (or truss) similar to that shown in FIG. 17 except that the truss guide is mounted on the exterior of the rail post.

FIG. 20 is a partial cross sectional view of another shoring system including an end assembly 200' of a mobile truss or spreader. It is slidably connected to a vertical rail 302.

The vertical rail post 302 includes a circular truss guide 304 on the outside (or in front of) the front plate 306. The truss guide 304 is adapted to be slidably received by a truss guide member 250 such that the spreader may be vertically moved along the vertical rail while horizontal movement is prevented.

The vertical rail post shown in FIG. 20 also includes securing members 308. The securing members 308 may be inclined and welded to the front and back plates of the vertical rail post. The securing members may also be welded or attached to other straight pieces, angles) tubes or flanges to further secure the vertical rail or to otherwise provide a supporting structure for the wall panels or truss guide.

The vertical rail includes channel tubes 310A, 310B mounted on opposing sides of the rail post. In particular, the channel tubes 310A, 310B are mounted to each straight plate 312A, 312B respectively. The channel tubes and straight plates define inner wall guides 314A, 314B and outer wall guides 316A, 316B that receive front and rear shoring wall panels respectively. Additionally, a rod or vertical round member 318, 320 is mounted to the back plate 307 and the channel tubes 310, as shown, to secure the wall panels. Each wall panel may be inserted into its corresponding wall panel guide and locked in place against the round member.

Figure 21:
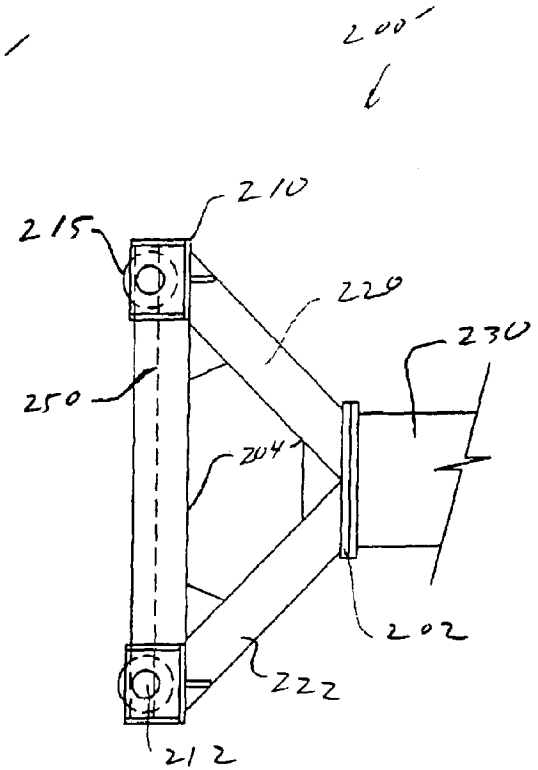
FIG. 21 is a side view of the mobile spreader shown in FIG. 20.

FIGS. 20 and 21 also show an end assembly 200' of a spreader for slidably engaging the vertical rail post. In particular, a truss guide member 250 of the spreader partially (or completely) coaxially surrounds truss guide 304 of the vertical rail. The truss guide member 250 may be, e.g., a vertical section of a tubular member. The cross section may form an arc having an angle greater than 180 degrees, and perhaps between 240 and 360 degrees.

The end assembly of the spreader also includes a number of rollers 215A, 215B to facilitate vertical movement of the truss. In particular, the spreader includes two rollers 215A, 215B per axle 212, similar to that shown in FIG. 19A. The end assembly 200' of the spreader also includes an upper and lower set of rollers corresponding to an upper and lower beam 220, 222 as depicted in FIG. 21.

An advantage of the shoring system depicted in FIGS. 20 and 21 is the use of wall panels having an equal length. The inner and outer wall panels may be identical to one another. Wall panels of equal length may be inserted or accepted by the shoring system shown in FIGS. 20 and 21 because the panel guides on each side of the rail post are in a common plane.

All publications, patent applications, patents, and other references mentioned hereinbefore are incorporated by reference in their entirety.

All of the features disclosed in the specification (including any accompanying claims, abstract and drawings), and/or all of the steps of any method or process disclosed, may be combined in any combination, except combinations where at least some of such features and/or steps are mutually exclusive. Each feature disclosed, in this specification (including any accompanying claims, abstract and drawings), may be replaced by alternative features serving the same, equivalent or similar purpose, unless expressly stated otherwise.

The invention is not restricted to the details of the foregoing embodiments. The invention extends to any novel one, or any novel combination, of the features disclosed in this specification (including any accompanying claims, abstract and drawings), or to any novel one, or any novel combination, of the steps of any method or process so disclosed.

What is claimed is:

1. A device for shoring a trench comprising:

a.) vertical rails, each said vertical rail having opposing sides, each said opposing side comprising at least two separated wall panel guides, an outer wall panel guide and an inner wall panel guide evenly aligned relative to center axis of said vertical rail, said wall panel guides being adapted to slidably interlock shoring panels sliding vertically within, and said vertical rail further comprising lengthwise a tubular truss guide having an arcuate cross section; and b.) a mobile truss comprising at least one spreader with two end assemblies fastened respectively via contact flanges on either end of said spreader, each said end assembly including a vertical section of a tubular member, said vertical section being further adapted to cooperatively engage said truss guide of said vertical rail; and c.) shoring panels, each said shoring panel having on either end a guide member fitting within any of said wall panel guides of vertical rail, said shoring panels being of equal length and having identical design of said guide members whether sliding within said outer wall guide or said inner wall guide of said vertical rail.

2. The device of claim 1 wherein:

said vertical rail comprises two straight member plates held a part parallel by a set of plate stiffeners distributed lengthwise in intervals, a back plate fastened perpendicularly onto respective ends of said straight member plates, two front plates fastened respectively onto either said straight member plate parallel to said back plate, and an open tube of arcuate cross section held in between said straight member plates by said plate stiffeners and said front plates;

each said front plate having one end projecting inward to center axis of said vertical rail, fastened onto respective lip of said open tube while the other end projecting laterally outward of said vertical rail;

said back plate projecting outward on opposing side of each said straight member plate shaping in combination with said front plates, a channel structure on either side of said vertical rail;

said vertical rail further comprising two U-shaped members fastened respectively onto either straight member plate in distance quasi equal from said front plate and said back plate shaping an outer wall guide and an inner wall guide when combined respectively with said back plate and said front plate; and each of said outer guide and each of said inner guide having inward a rod member fastened respectively onto said back plate and said U-shaped member.

3. The device of claim 2 wherein the width of each said front plates is narrower on the upper half of said vertical rail than on the lower half.

4. The device of claim 1 wherein:

said vertical rail comprises a back plate and a front plate holding perpendicularly in between two parallel straight member plates spaced apart to define an entirely closed box beam, and a truss guide of circular cross section fastened onto said front plate outward to the rail;

said back plate and said front plate projecting outward on opposing side of each said straight member plate shaping a channel structure on either side of said vertical rail;

said vertical rail further comprising two U-shaped members fastened respectively on either straight member plate in distance quasi equal front said front plate and said back plate shaping an outer wall guide and an inner wall guide when combined respectively with said back plate and said front plate; and each said outer guide and each said inner guide having inward a rod member fastened respectively onto said back plate and said U-shaped member.

5. The device of claim 4 wherein the width of said front plate is narrower for the upper half of said vertical rail than for the lower half.

6. The device of claim 2 wherein each said vertical rail includes at least one hole for receiving a fastener to lock said mobile truss in place.

7. The device of claim 2 wherein each said end assembly of said truss comprises at least one roller.

8. The device of claim 7 wherein said arcuate cross section forms an arc having an angle greater than 180 degrees.

9. The device of claim 1 further comprising an inner wall panel and an outer wall panel wherein the inner wall panel and outer wall panel are equal in length.

10. The device of claim 9 wherein the inner wall panel guide and the outer wall panel guide on one side of the vertical rail are in a first plane.

11. The device of claim 1 wherein each said end assembly of the truss comprises at least one roller.

12. The device of claim 1 wherein each said end assembly of the truss comprises an upper and lower assembly, each of said upper and lower assemblies comprising at least one roller.

13. The device of claim 12 wherein each of said upper and lower assemblies comprises at least two rollers rotatably mounted on an axle.

14. The device of claim 1 wherein each said vertical rail includes at least one hole for receiving a fastener to lock the truss in place.

15. The device of claim 1 comprising at least four of said vertical rails, said vertical rails being positioned opposite one another along sides of the trench.

16. The device of claim 15 comprising one movable truss per two opposite rail posts.

17. The device of claim 16 wherein inner and outer wall panels are inserted between adjacent rails posts to form shoring walls.

18. The device of claim 17 further comprising four corner posts, each corner post comprising perpendicular sides and each said perpendicular side comprising an inner panel guide and an outer panel guide for slidably interlocking wall panels.

19. The device of claim 17 wherein the inner and outer wall panels are identical to one another.

20. The device of claim 19 wherein the inner and outer wall panels face the same direction.

21. A device for shoring a trench comprising:

a.) at least two vertical rails, each of said vertical rails comprising opposing sides, each said opposing side comprising an inner wall panel guide and an outer wall panel guide, each said inner wall panel guide being adapted to slidably interlock with an inner wall panel and each said outer wall panel guide being adapted to slidably interlock with an outer wall panel such that the inner and outer wall panels may be moved vertically, and each said vertical rail further comprising a vertically disposed truss guide having a round cross section; and b.) a mobile truss comprising a frame and end assemblies, wherein each said end assembly is adapted to cooperatively engage said truss guide of said vertical rail when the vertical rails are positioned across from one another in the trench such that said truss may be moved vertically, wherein the truss guide is a tube, wherein the truss guide is exteriorly mounted on said vertical rail, and wherein each end assembly of the truss includes a vertical section of a tubular member, said vertical section having an arcuate cross section.

22. The device of claim 21 wherein said arcuate cross section forms an arc having an angle greater than 180 degrees.

23. A device for shoring a trench comprising:

a.) at least two vertical rails, each said vertical rails comprising opposing sides, each said opposing side comprising an inner wall panel guide and an outer wall panel guide, each said inner wall panel guide being adapted to slidably interlock with an inner wall panel and each said outer wall panel guide being adapted to slidably interlock with an outer wall panel such that the inner and outer wall panels may be moved vertically, and each said vertical rail further comprising a vertically disposed truss guide having a round cross section; and b.) a mobile truss comprising a frame and end assemblies, wherein each said end assembly is adapted to cooperatively engage said truss guide of said vertical rail when the vertical rails are positioned across from one another in the trench such that said truss may be moved vertically, wherein the truss guide is situated within the vertical rail, wherein the truss guide is a vertical section of a tubular member, said vertical section having an arcuate cross section, and wherein said arcuate cross section forms an arc having an angle greater than 180 degrees.

24. A device for shoring a trench comprising:

a.) at least two vertical rails, each of said vertical rails comprising opposing sides, each said opposing side comprising an inner wall panel guide and an outer wall panel guide, each said inner wall panel guide being adapted to slidably interlock with an inner wall panel and each said outer wall panel guide being adapted to slidably interlock with an outer wall panel such that the inner and outer wall panels may be moved vertically, and each said vertical rail further comprising a vertically disposed, exteriorly mounted, tubular truss guide having a tubular cross section; and b.) a mobile truss comprising a frame and end assemblies, wherein each said end assembly includes a vertical section of a tubular member, said vertical section having an arcuate cross section, and is adapted to cooperatively engage said tubular truss guide of said vertical rail when the vertical rails are positioned across from one another in the trench such that said truss may be moved vertically.

25. The device of claim 24 wherein said arcuate cross section forms an arc having an angle greater than 180 degrees.

26. The device of claim 24 further comprising an inner wall panel and an outer wall panel wherein the inner wall panel and outer wall panel are equal in length.

27. The device of claim 26 wherein the inner wall panel guide and the outer wall panel guide on one side of the vertical rail are in a first plane.

28. The device of claim 24 wherein each said end assembly of the truss comprises at least one roller.

29. The device of claim 24 wherein each said end assembly of the truss comprises an upper and lower assembly, each of said upper and lower assemblies comprising at least one roller.

30. The device of claim 29 wherein each of said upper and lower assemblies comprises at least two rollers; rotatably mounted on an axle.

31. The device of claim 24 wherein each said vertical rail includes at least one hole for receiving a fastener to lock the truss in place.

32. The device of claim 24 comprising at least four of said vertical rails, said vertical rails being positioned opposite one another along sides of the trench.

33. The device of claim 32 comprising one movable truss per two opposite rail posts.

34. The device of claim 32 wherein inner and outer wall panels are inserted between adjacent rails posts to form shoring walls.

35. The device of claim 24 comprising at least four of said vertical rails, said vertical rails being positioned opposite one another along sides of the trench.

36. The device of claim 35 comprising one mobile truss per two opposite rail posts.

37. The device of claim 35 wherein inner and outer wall panels are inserted between adjacent rails posts to form shoring walls.

38. The device of claim 32 further comprising four corner posts, each corner post comprising perpendicular sides and each said perpendicular side comprising an inner panel guide and an outer panel guide for slidably interlocking wall panels.

39. The device of claim 34 wherein the inner and outer wall panels are identical to one another.

40. The device of claim 39 wherein the inner and outer wall panels face the same direction.

41. A device for shoring a trench comprising:

a.) at least two vertical rails, each of said vertical rails comprising opposing sides, each said opposing side comprising an inner wall panel guide and an outer wall panel guide, each said inner wall panel guide being adapted to slidably interlock with an inner wall panel and each said outer wall panel guide being adapted to slidably interlock with an outer wall panel such that the inner and outer wall panels may be moved vertically, and each said vertical rail further comprising a vertically disposed truss guide situated within the vertical rail, the truss guide having an arcuate cross section forming an arc with a subsected angle greater than 180 degrees; and b.) a mobile truss comprising a frame and end assemblies, wherein each said end assembly is adapted to cooperatively engage said truss guide of said vertical rail when the vertical rails are positioned across from one another in the trench such that said truss may be moved vertically.

42. The device of claim 41 wherein said arcuate cross section forms an arc having an angle greater than 180 degrees.

43. The device of claim 41 further comprising an inner wall panel and an outer wall panel wherein the inner wall panel and outer wall panel are equal in length.

44. The device of claim 43 wherein the inner wall panel guide and the outer wall panel guide on one side of the vertical rail are in a first plane.

45. The device of claim 41 wherein each said end assembly of the truss comprises at least one roller.

46. The device of claim 41 wherein each said end assembly of the truss comprises an upper and lower assembly, each of said upper and lower assemblies comprising at least one roller.

47. The device of claim 46 wherein each of said upper and lower assemblies comprises at least two rollers rotatably mounted on an axle.

48. The device of claim 41 wherein each said vertical rail includes at least one hole for receiving a fastener to lock the truss in place.

49. The device of claim 41 comprising at least four of said vertical rails, said vertical rails being positioned opposite one another along sides of the trench.

50. The device of claim 49 comprising one mobile truss per two opposite rail posts.

51. The device of claim 49 wherein inner and outer wall panels are inserted between adjacent rails posts to form shoring walls.

52. The device of claim 50 further comprising four corner posts, each corner post comprising perpendicular sides and each said perpendicular side comprising an inner panel guide and an outer panel guide for slidably interlocking wall panels.

53. The device of claim 50 wherein the inner and outer wall panels are identical to one another.

* * * * *